US007404722B2

(12) United States Patent
Ikeya et al.

(10) Patent No.: US 7,404,722 B2
(45) Date of Patent: Jul. 29, 2008

(54) LEVER TYPE CONNECTOR

(75) Inventors: Kenichi Ikeya, Shizuoka-ken (JP); Ronald Alan Cabangal, Shizuoka-ken (JP); Hideki Inoue, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/925,435

(22) Filed: Oct. 26, 2007

(65) Prior Publication Data

US 2008/0102667 A1 May 1, 2008

(30) Foreign Application Priority Data

Oct. 27, 2006 (JP) ..... P2006-292309

(51) Int. Cl.
*H01R 13/62* (2006.01)

(52) U.S. Cl. ..... 439/157

(58) Field of Classification Search ..... 439/157, 439/557, 544

See application file for complete search history.

(56) References Cited

U.S. PATENT DOCUMENTS 5,672,068 A * 9/1997 Tsuchiya et al. ..... 439/157
5,876,226 A * 3/1999 Tsukakoshi et al. ..... 439/157
6,213,793 B1 * 4/2001 Norizuki et al. ..... 439/157
6,390,835 B1 * 5/2002 Okabe et al. ..... 439/157
6,419,507 B2 * 7/2002 Kurimoto ..... 439/157

FOREIGN PATENT DOCUMENTS

JP 2946000 7/1999

* cited by examiner

*Primary Examiner*—Briggitte R Hammond
(74) *Attorney, Agent, or Firm*—Finnegan, Henderson, Farabow, Garrett & Dunner L.L.P.

(57) ABSTRACT

A lever type connector comprises two connector housings, a front holder, a movable guide member fixed within one of the connector housings, and a movable guide member slidably attached to another of the connector housings. The movable guide member protects male terminals at a temporary holding position and is slid by the front holder toward an end position during connection. A elastic arm for temporarily holding the movable guide member is provided within the connector with the male terminals. A release projection is provided on the front holder. A space for stowing the elastic arm, which has restored its bending, is secured behind the release projection. According to the lever type connector can prevent plastic deformation of the elastic arm for temporary holding of the movable guide member without forming an access hole by a telescoping shutoff of injection molding.

4 Claims, 25 Drawing Sheets

LEVER TYPE CONNECTOR

BACKGROUND OF THE INVENTION

1. Field of the Invention

The present invention relates to a lever type connector having a movable guide member (also called "movable plate"), which is installed in a connector housing having male terminals therewithin, protects distal ends of the male terminals, and assist respective connections between male and female terminals.

2. Description of the Related Art

FIG. 1 to FIG. 6 show one example of a conventional lever type connector described in Japanese Patent No. 2946000. As shown in FIG. 1 and FIG. 2, the lever type connector comprises a male connector 910, a female connector 920 and a movable guide member 930. The female connector 920 includes an aperture 922 for stowing the male connector 910. The movable guide member 930 is installed slidably within the aperture 922 and slides a connecting direction of the male connector 910. The movable guide member 930 also protects and guides terminals 960 projecting within the aperture 920.

The movable guide member 930 includes a main plate 932 and a pair of barbed arms 936. The main plate 932 has a plurality of holes 934 concerning the mail terminals. The pair of barbed arms 936 extend from both side edges of the main plate 932 perpendicularly to the main plate 932. Each barbed arms 936 has a slit 938 extending in the connecting direction and a pawl 940 disposed on its distal end for temporary engagement. As shown in FIG. 3, the pawl 940 is engaged between projections 926, 928 provided on an inner surface 944 of the aperture 922 and then the moving movable guide member 930 is engaged temporarily.

In addition, a pair of projections 912 is provided on both sidewalls of the male connector 910. Each projection 912 is slidably engaged with the respective slit 938 of the respective barbed arm 936. As shown in FIG. 4 and FIG. 5, during the connection of the connectors 910, 920, the projection 940 firstly gets over the pawl 940 which is held temporarily between the projections 926, 928. An arrow shown in FIG. 4 and FIG. 5 indicates an inserting direction of the male connector 910. And then, the movable guide member 930 is pushed backward by the male connector 910. Next, engagement between the pawl 940 and the projection 928 is released to enable sliding of the movable guide member 930.

Finally, the barbed arm 936 has served its purpose at the release between the pawl 940 and the projection 928 and then stowed at space 929 secured behind the projection 928 with a bend back state. Therefore, continuous bending of the barbed arms 936 is prevented and then occurrence of superfluous plastic deformation is prevented.

In the above-described lever type connector, the spaces 929 for stowing the barbed arm 938 are secured behind the projections 928 respectively. Therefore, a access hole, which is made by a telescoping shutoff of injection molding to mold an undercut portion, is needed on a connector housing of the female connector 920 to secure the respective space 929 at molding. As a result, waterproof structure and enclosed structure are needed for the female connector 920. These structures may produce disadvantageous condition and then it is difficult to adopt the above-mentioned structure actually.

Alternatively, if the spaces 929 are not secured behind the projections 928, the access holes by the telescoping shutoffs are not made. However, the barbed arms 936 may be continuously bent under the connecting state of the connectors 910, 920 and then superfluous plastic deformation may occur with the barbed arms 936. As a result, temporary holding performance of the movable guide member 300 may be reduced.

SUMMARY OF THE INVENTION

In view of the above-described situation, the present invention has an object to provide a lever type connector which is capable of preventing plastic deformation of elements for temporary holding of a movable guide member without forming an access hole by a telescoping shutoff of injection molding.

An aspect of the present invention provides a lever type connector which comprises: a first connector housing which has female terminals therein and an aperture opening forward; a second connector housing to be connected with the first connector housing, which has male terminals to be electrically connected with the female terminals and has an aperture opening forward; a front holder which is inserted through the aperture of the first connector housing and fixed thereon; and a movable guide member which is inserted through the aperture of the second connector housing and slidably attached thereto. The movable guide member is temporarily held at a temporary holding position before connection of the female and male connector housings, and released from a temporary holding and slid toward an end position by the front holder to guide the male terminals into the female terminals as the connection proceeds. An elastic arm, which temporarily holds the movable guide member at the temporary holding position, is provided inside the second connector housing. A release projection, which is contacted with the elastic arm to bend the elastic arm toward a release direction for releasing the temporary holding, is provided on the front holder. A space, which stows the elastic arm restoring bending after releasing the temporary holding, is secured behind the release projection in a connecting direction.

According to the aspect of the present invention, the release projection is firstly contacted with the elastic arm and then the elastic arm is bent toward the release direction for releasing temporary holding of the movable guide member. The movable guide member can be slidable and the front holder pushes the movable guide member to slide the movable guide member as the connection proceeds. The movable guide member is pushed to the end position under the complete connection. In this state, since the space is secured behind the release projection of the front holder, the elastic arm, which has restored its bending at the complete connection after the temporary connection, is stowed in the space.

Therefore, continuous bending of the elastic arm under the connecting state of the connector housings is prevented. As a result, reduction of temporary connecting performance is prevented. In addition, since the elastic arm is not bent under the temporary or complete connecting state, it is prevented that an external force would act on the elastic arm even when the external force acts on the connector housings. As a result, durability against an external force is improved.

Furthermore, the release projection, which bends the elastic arm toward the release direction as the connection proceeds, is provided not directly on the first connector housing but on the front holder attached to the first connector housing. Since the space would not become an undercut portion of injection molding, an access hole, which is often made by a telescoping shutoff of injection molding to mold an undercut portion, is not made on the first connector housing for the space. Therefore, it could never happen that water infiltrates into the inside of the connector housings through an access hole. As a result, deterioration of waterproofing and noise-and-vibration performances concerning the first connector is prevented.

It is preferable that the lever type connector further comprises: an engaging portion, which is to be engaged with the elastic arm, is provided on the movable guide member; a pawl, which is engaged with the engaging portion to hold the movable guide member temporarily, is disposed on a distal end of the elastic arm; a first slope, which is to be contacted with the release projection as the connection proceeds to receive a force for bending the elastic arm toward a release direction, is provided on the elastic arm; and a pair of the pawl and the engaging portion offsets from a pair of the release projection and the first slope in a perpendicular plane to the connecting direction.

In this way, since the pair of the pawl and the engaging portion offsets from the pair of the release projection and the first slope in a perpendicular plane to the connecting direction, compact design, such as short length in the connecting direction, can be provided.

Here, it is further preferable that the lever type connector further comprises a second slope, which is to be contacted with the release projection as a disconnection proceeds to receive a force for bending the elastic arm toward a release direction, is provided on the distal end of the elastic arm.

In this way, since the second slope, which is disposed on a distal end of the elastic arm, bends the elastic arm toward the release direction by contacting with the release projection of the front holder at the disconnection, the connector housings can be disconnected smoothly.

Here, it is further preferable that the lever type connector further comprises a lever which is rotatably attached to one of the first and second connector housings and has cam grooves; and cam pins which are provided on another of the first and second connector housings and guided by the cam grooves respectively. The connection or disconnection of the first and second connector housings is assisted by rotating the lever in a state where the cam pins are inserted into the cam grooves respectively.

DESCRIPTION OF THE PREFERRED EMBODIMENT

Figure 1:
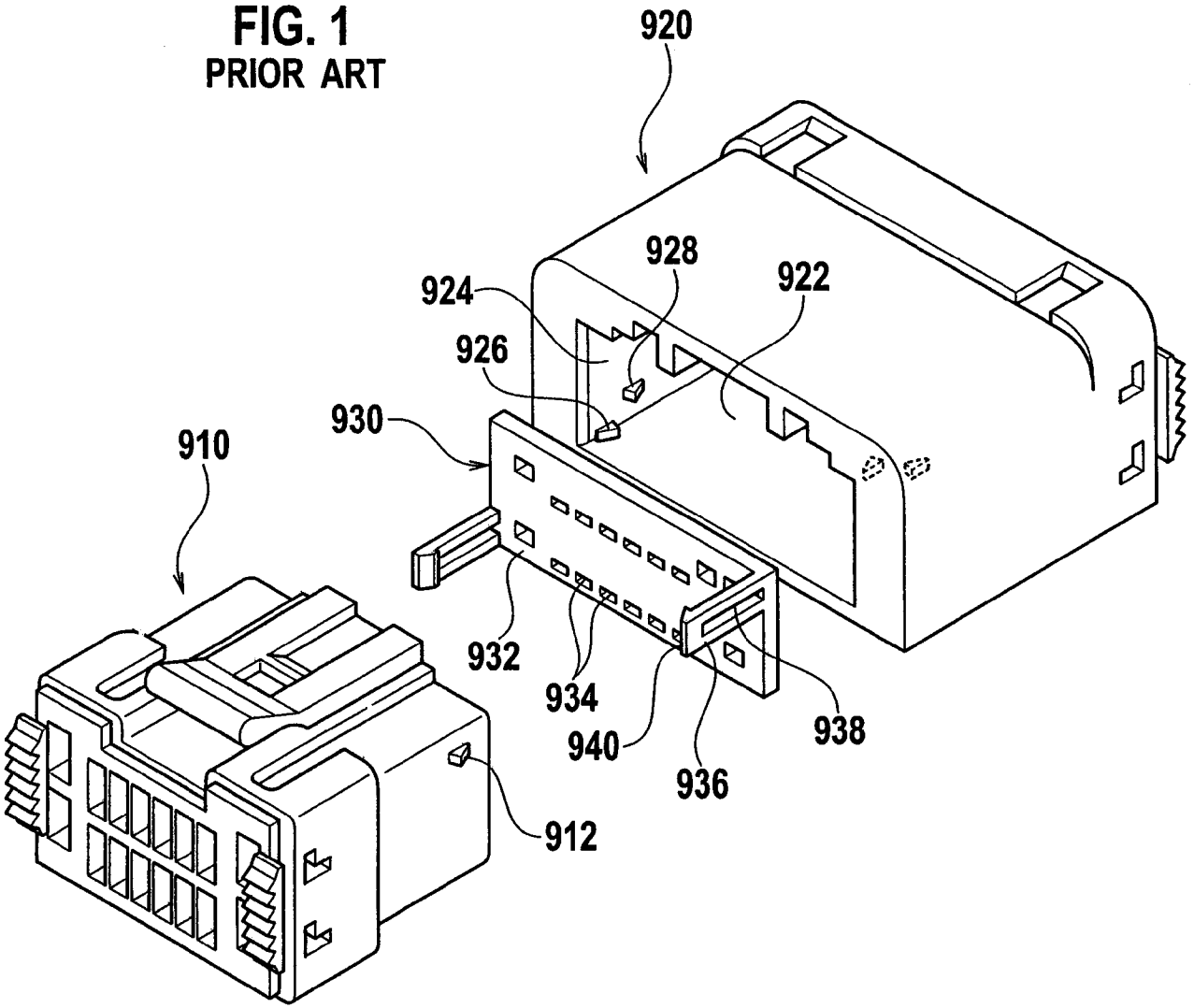
FIG. 1 PRIOR ART
FIG. 1 is an exploded perspective view showing one example of a conventional lever type connector.
Figure 2:
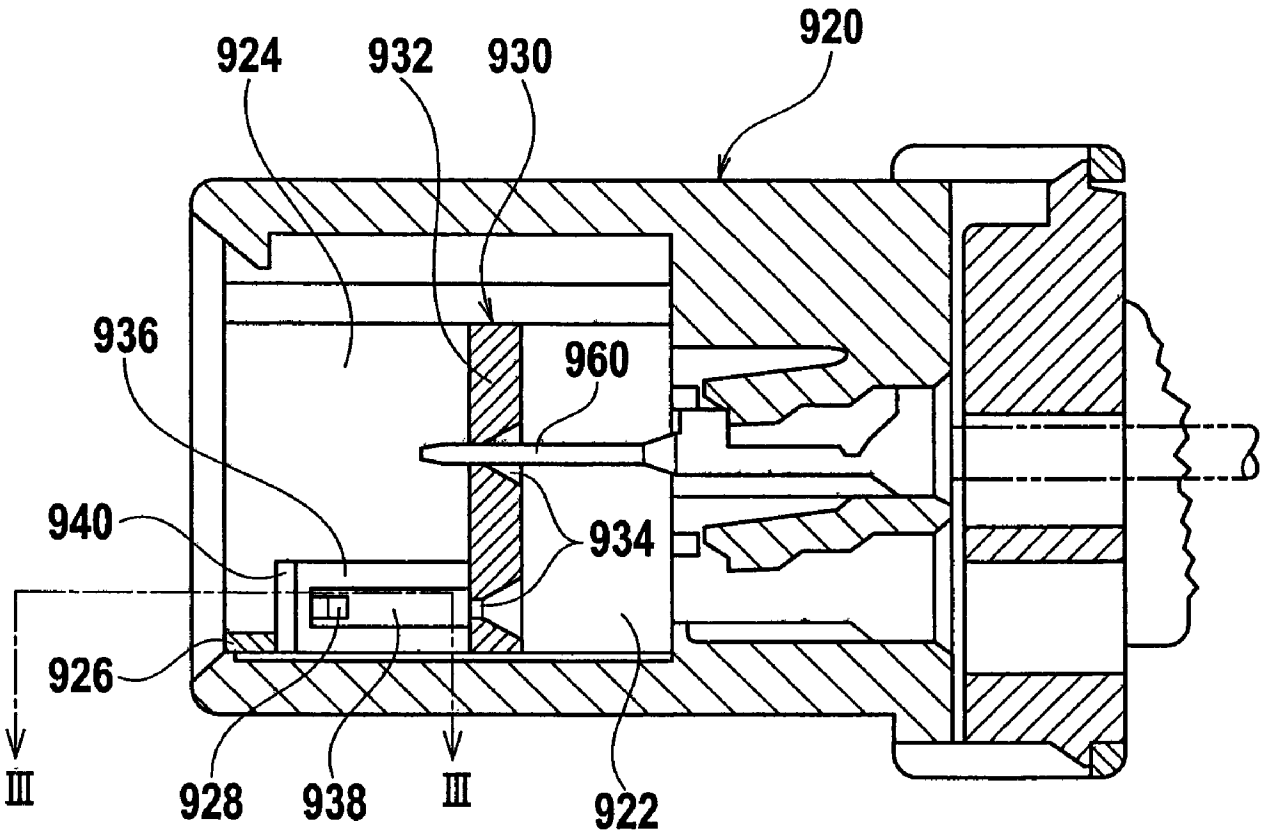
FIG. 2 PRIOR ART
FIG. 2 is a cross-sectional view showing a female connector and a movable plate in the example of a conventional lever type connector.
Figure 3:
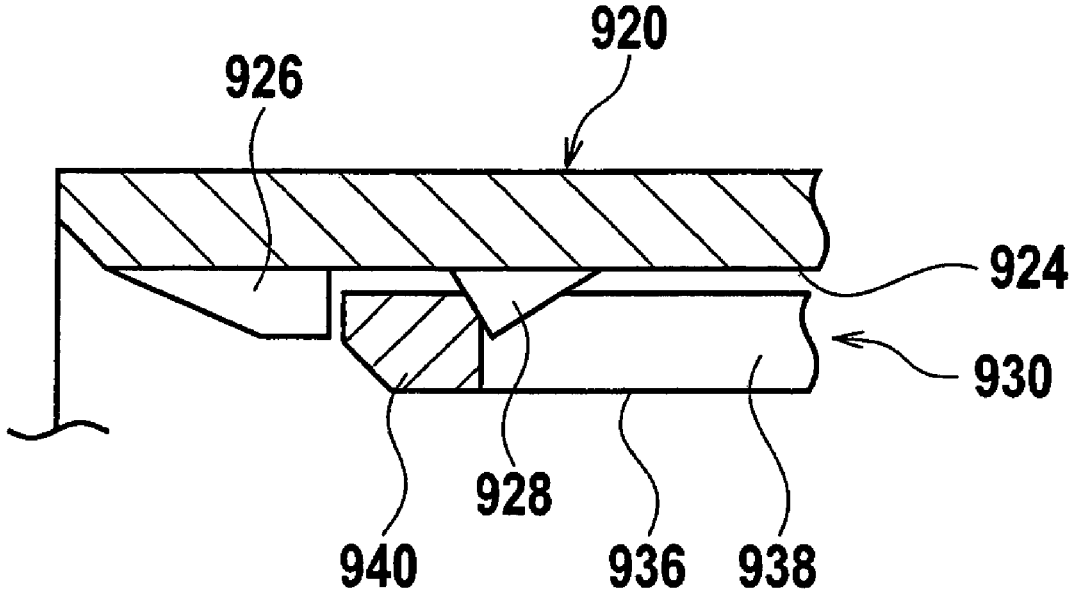
FIG. 3 PRIOR ART
FIG. 3 is a cross-sectional view taken along line III-III in FIG. 2.
Figure 4:
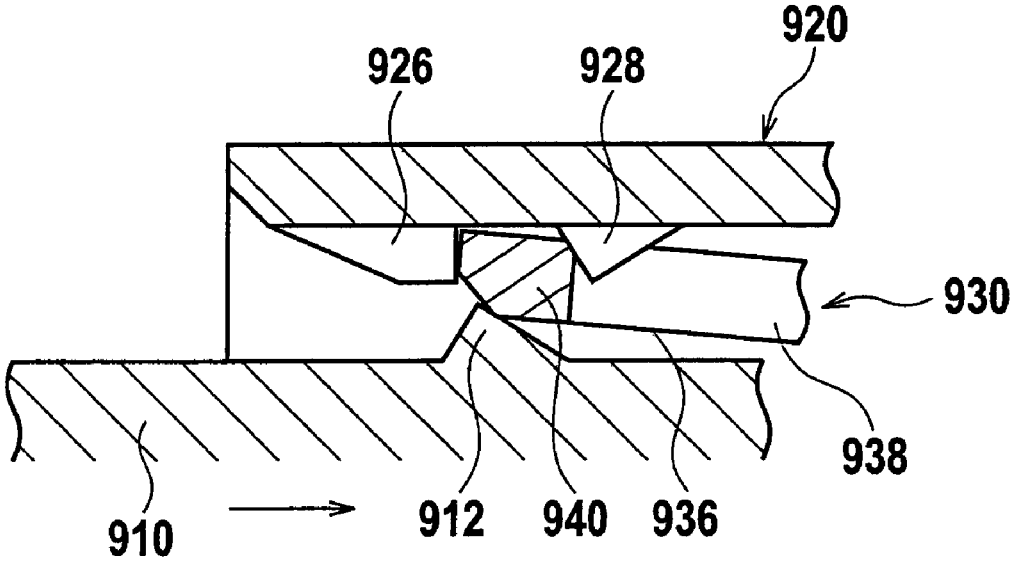
FIG. 4 PRIOR ART
FIG. 4 is a cross-sectional view showing a next stage to a stage shown in FIG. 3.
Figure 5:
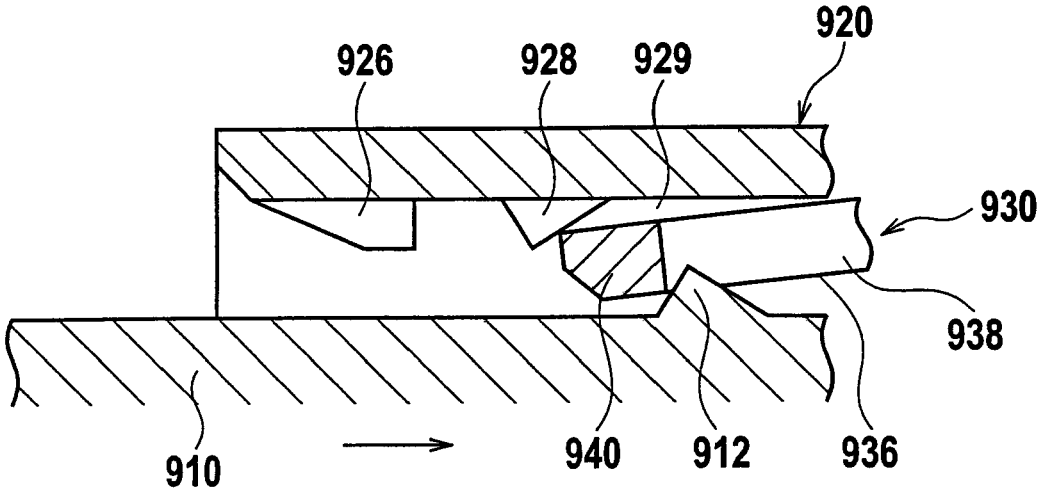
FIG. 5 PRIOR ART
FIG. 5 is a cross-sectional view showing a next stage to a stage shown in FIG. 4.
Figure 6:
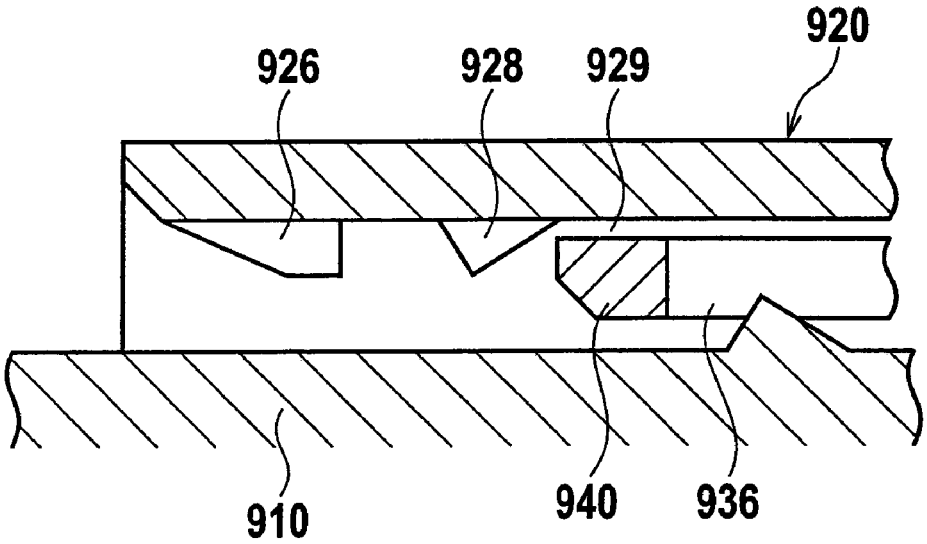
FIG. 6 PRIOR ART
FIG. 6 is a cross-sectional view showing a next stage to a stage shown in FIG. 5.

In the following, an embodiment of the present invention will be described with references to the drawings.

A lever type connector of this embodiment mainly comprises a female connector 100, a male connector 200, a front holder 300, a movable plate (movable guide member) 400, a lever 500, and a cover 600. The female connector 100 and the male connector 200 are to be connected with each other. The front holder 300 is attached inside a front aperture 102 of a housing (female connector housing) 101 of the female connector 100. The movable plate 400 is attached inside a hood 202 of a connector housing (male connector housing) 201 of the male connector 200. The movable plate 400 is attached inside a front aperture 202*a* of the hood 202 and slidable in a connecting direction (a forward and backward direction) within the food 202. The lever 500 is attached to an outer side of the female connector 100. The cover 600 is attached to the female connector 100 in order to cover a backside of the female connector 100.

Female terminals (not shown in the figures) are installed within a cavity of the female connector housing 101. The hood 202 of the male connector 200 is inserted inside the front aperture 102 of the female connector housing 101. Each connecting portions of the female and male connector housings 101, 201 has an almost vertically long rectangle shape with being viewed from respective front side. Both right and left sidewalls of the food 202 of the male connector housing 201 are to be inserted within both right and left sidewalls of the female connector housing 101.

In addition, the female terminals, each of which is prevented from pulling-out by its lance (another holding structure), are unfailingly held by the front holder 300 attached to the female connector 100 from its front side. Each of the female terminals is doubly held by its lance and the front holder 300.

Furthermore, male terminals (not shown in the figures) are installed within a cavity of the male connector housing 201. The hood 202, which is extending towards a front side, is inserted inside the front aperture 102 of the female connector 100. The metallic terminals, each of which is held by its lance, is protected by the movable plate 400 installed slidably within the hood 202 of the male connector 200 from its front side. The female terminals are electrically connected with the corresponding male terminals respectively when the female and male connectors 100, 200 have been connected completely.

Figure 7:
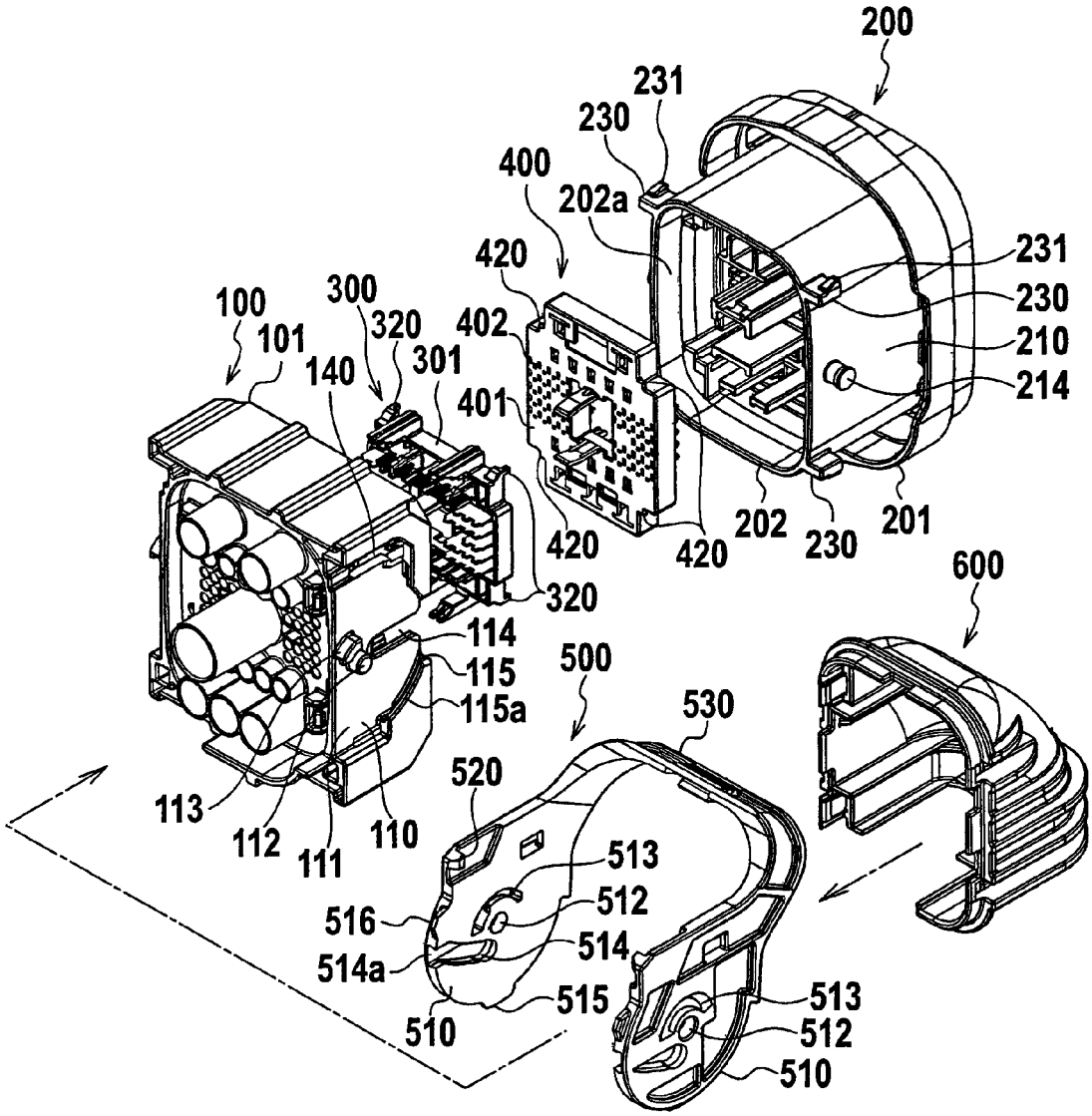
FIG. 7 is an exploded perspective view of a lever type connector of one embodiment of the present invention.
Figure 8:
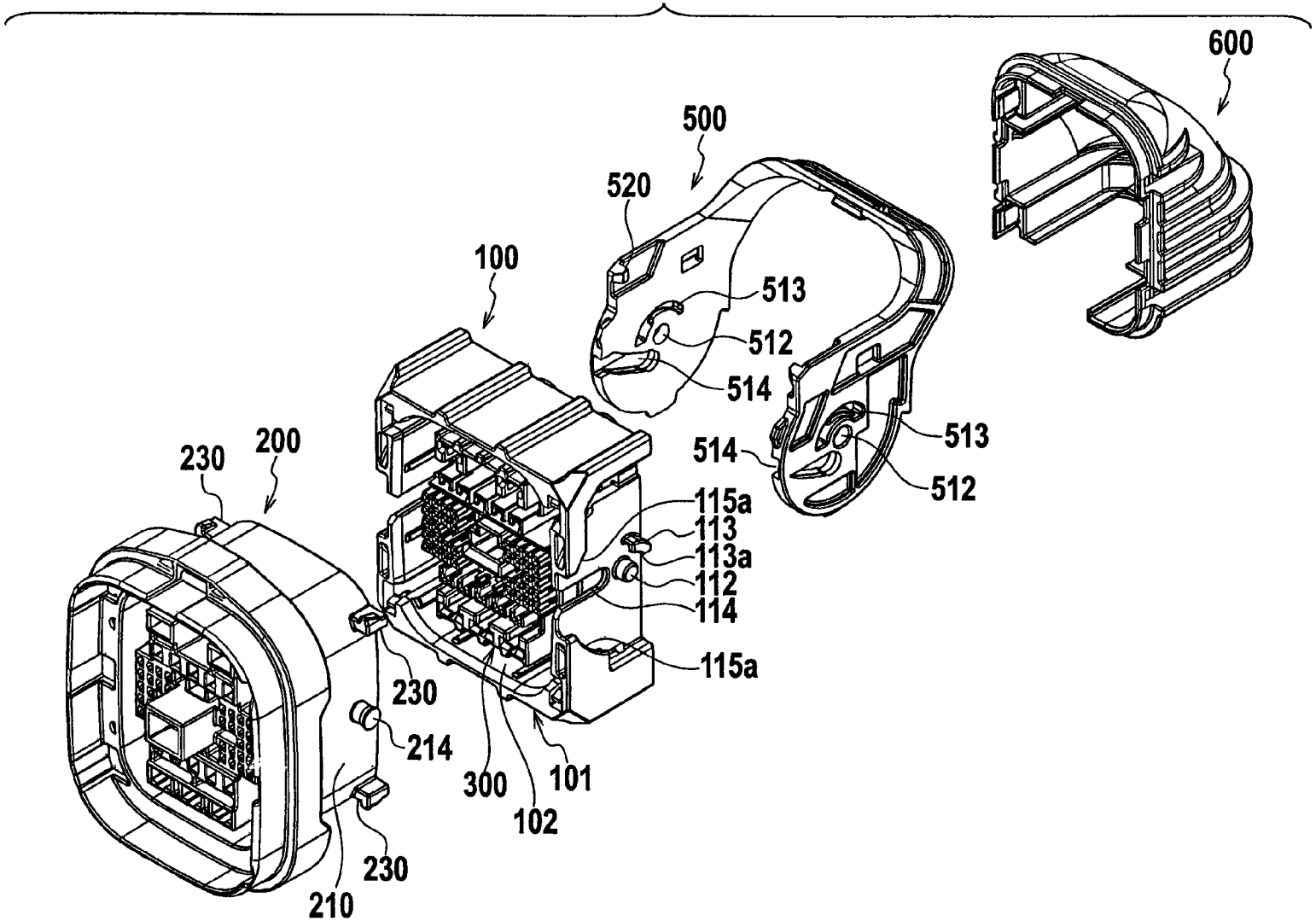
FIG. 8 is an exploded perspective view showing the lever type connector of the embodiment (a pair of connector housings are viewed from different angle from FIG. 7)
Figure 9:
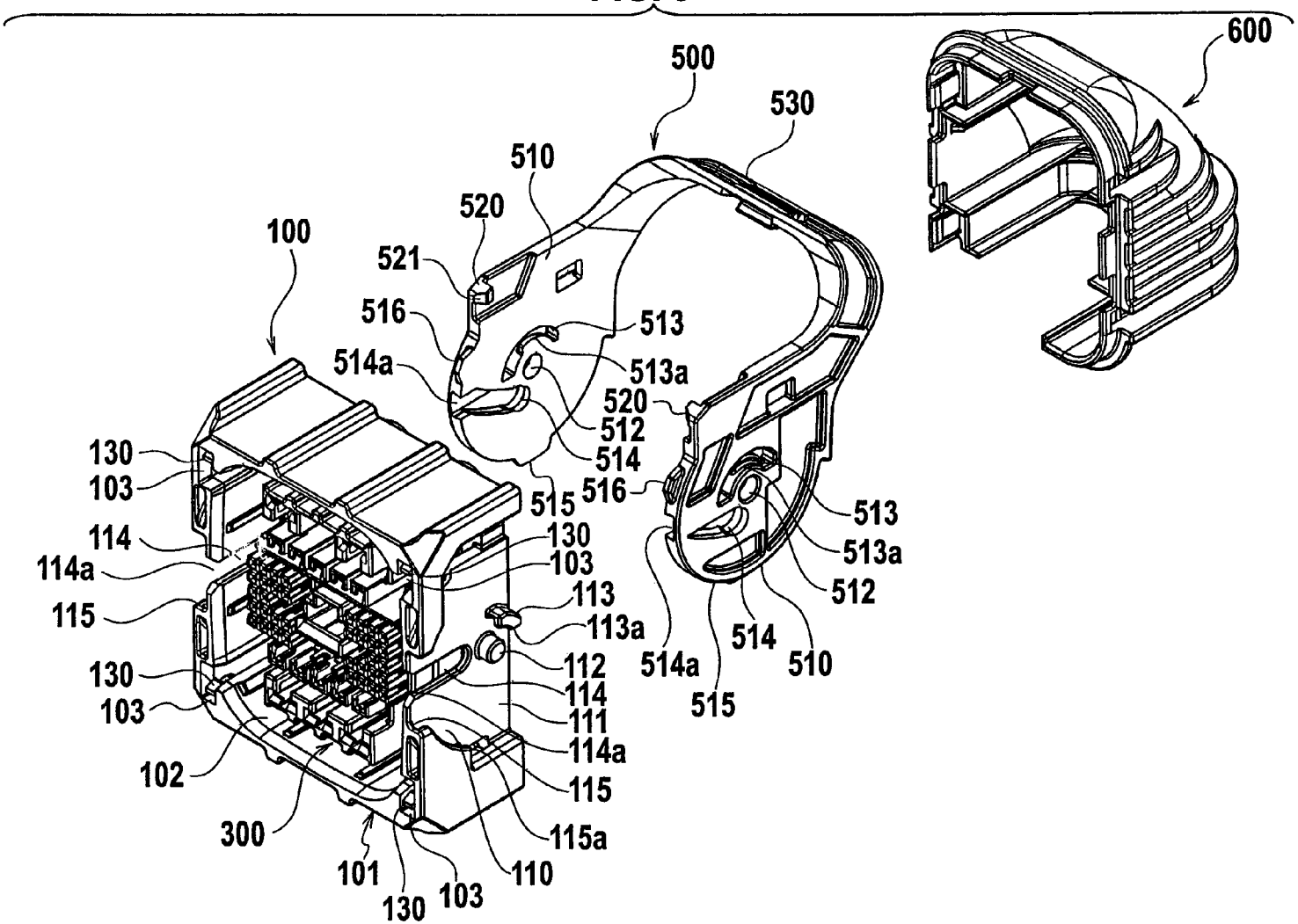
FIG. 9 is an exploded perspective view showing a configuration of a female connector of the embodiment.

As shown in FIG. 7, the movable plate 400 is made by forming a plurality of thorough holes on a main plate 401 in order to guide the male terminals. The movable plate 400 holds the male terminals of the male connector 200 at their regular positions while connecting with the female terminals in order to prevent deformation of distal ends of the male terminals. Furthermore, the movable plate 400 is slid towards from a temporarily connecting position in a frontside to a completely connecting position in a backside by being pushed by the female connector 100 in order to guide the connecting between the female and mail terminals.

As shown in FIG. 7 and FIGS. 23 to 25, hooking tabs (engaging portions) 420 are formed on the movable plate 400 for a temporary connection of the pair of the connector housings. In addition, barbed arms 220 are also formed inside the male connector housing 201 for the temporary connection. Each of the barbed arms 220 can bend with its elastic deflection.

Furthermore, release projections 320 for releasing the temporary connection are provided on each corners of a rectangle plate 301 of the front holder 300, which is inserted into the female connector 200 and fixed thereon. The respective barbed arms 220 are bent toward a release direction when the respective barbed arms 220 contact with the respective release projections 320, and then respective temporary engagements between the barbed arms 220 and the hooking tabs 400 are released.

Each of the barbed arms 220 includes a pawl 221 on its distal end, a first slope 222 and a second slope 223. The pawl 221 is engaged with the hooking tab 420 of the movable plate 400 in order to engage the movable plate 400 temporarily. The first slope 222 contacts with the release projection 320 to bend the barbed arm 220 toward the release direction when the connectors 100, 200 are to be connected. The second slope 223 is disposed on a distal surface of the pawl 221. The second slope 223 contacts with the release projection 320 to bend the barbed arm 220 toward the release direction when the connectors 100, 200 are to be disconnected. Each of the release projection 320 includes a first contact wall 321 and a second contact wall 322. The first contact wall 321 is a perpendicular wall disposed on a front end of the release projection 320 and contact with the first slope 222 of the barbed arm 220. The second contact wall 322 is an inclined wall disposed on a rear end of the release projection 320 and contact with the second slope 223 of the barbed arm 220.

Figure 25:
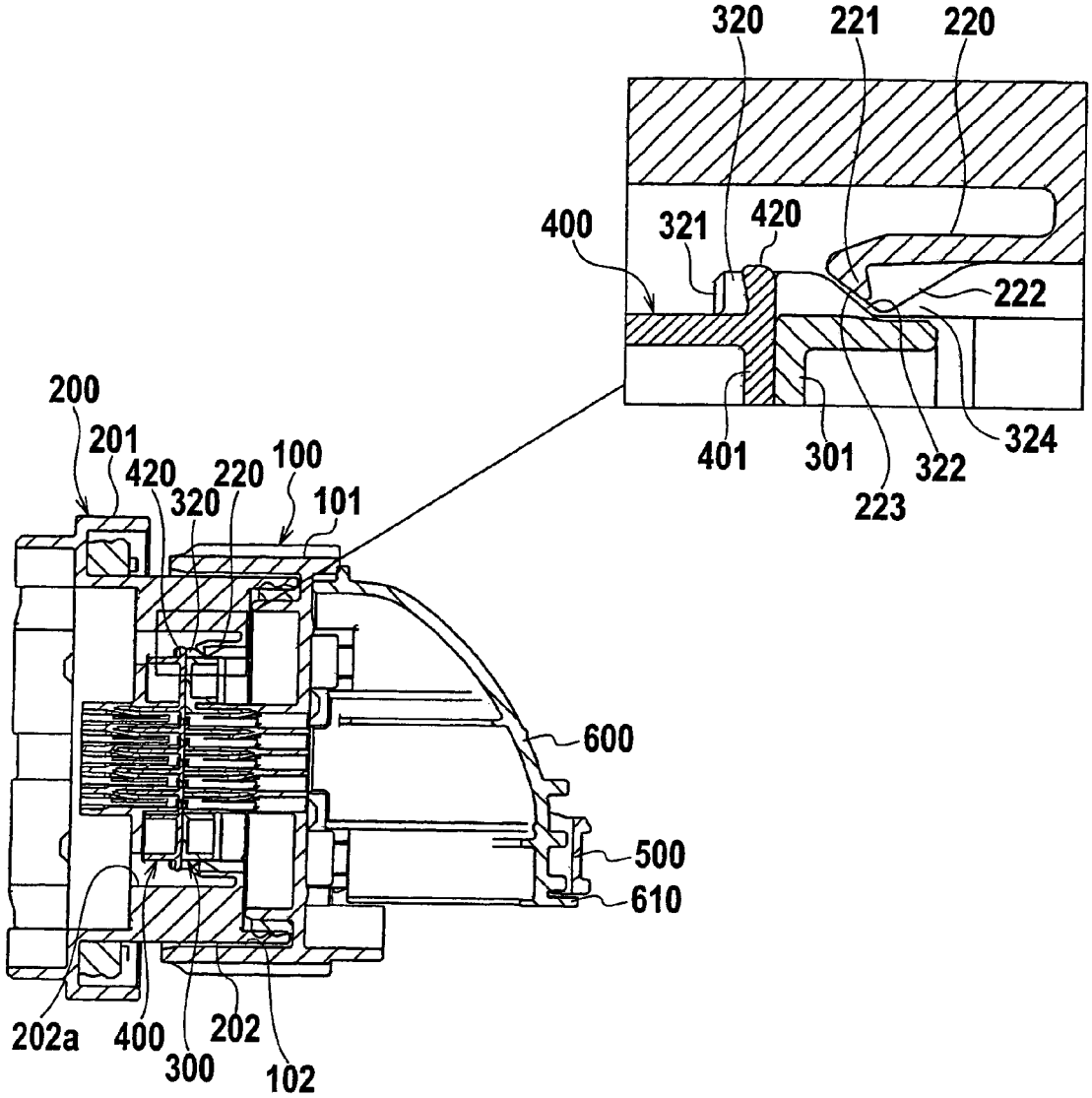
FIG. 25 is a cross-sectional view showing the female and male connectors connected completely (a portion is shown in close-up view).

Each pair of the pawl 221 and the hooking tab 420 offsets from each pair of the release projection 320 and the first slope 222 respectively in a perpendicular plane to a connecting direction of the connectors 100, 200. A space 324 is secured behind the release projection 320 for the barbed arm 220, which has restored its bending at a complete connection after the temporary connection, respectively (FIG. 25).

A lever attaching plane 111, which is formed one step lower than surrounding plane, is provided on a pair of right and left side planes 110 of the female connector housing 101, respectively. A respective side plate 510 of the lever 500 is coupled on each of the lever attaching face 111.

The lever 500 is used for connecting the connector and has an arch-shape. The lever 500 has a pair of side plates 510, each of which has an approximately circular-shape, and a knob 530 bridging the pair of side plates 510. An axial hole (coupling portion) 512, a slit 513, and a cam groove 514 are formed on each of the side plate 510. The respective cam groove 514 is formed on an inner face of the respective side plate 510. A respective entry gate 514*a* of the respective cam groove 514 is opening at a circumferential edge of the respective side plate 510.

The respective slit 513 extends in an arc shape around the axial hole 512 (a rotation center of the lever 500). The respective slit 513 has a tab 513*a* on its inner edge. The respective slit 513 extends in an overall rotating angle range of the lever 500 (including an attaching angle of the lever 500) around the respective axial hole 512 (center of the angle). The tab 513*a* extends in an ordinary rotating angle range of the lever 500. The ordinary rotating angle range (ordinary rotating range) will be described below.

The respective cam groove 514 extends in a prescribed angle range around the respective axial hole 512 (center of the angle). A distance from the axial hole 512 to the cam groove 514 decreases gradually from the entry gate 514*a* towards an opposite end, respectively.

A pin (coupling portion) 112, to which the axial hole 512 of the lever 500 is to be rotatably coupled, is provided on each of the lever attaching planes 111 on both sides of the female connector housing 101. The lever 500 is rotatably attached to the female connector housing 101 by coupling the pins 112 with the axial holes 512. The lever 500 is rotatable in a prescribed angle range, which is defined by a length of the slit 513, around the pin 112 (center of the angle). A respective guiding slit 114 is provided on a front side of the respective pin 112. Each of the guiding slits 114 extends straight from the entry gate 114*a* at a front end to a vicinity of the pin 112.

In addition, a hook 113 is provided around the pin 112 on each of the lever attaching plane 111. Each hook 113 is slidably coupled with the slit 513. A tab 113*a*, which hooks the tab 513*a* of the slit 513, is provided at a tip end of the hook 113. The uncoupling of the lever 500 from the pins 112 is prevented by engagement between the tab 113*a* and the tab 513*a*.

Furthermore, two tabs 515, 516 are provided on a circumferential edge of the respective side plate 510 of the lever 500 at some interval.

Figure 11:
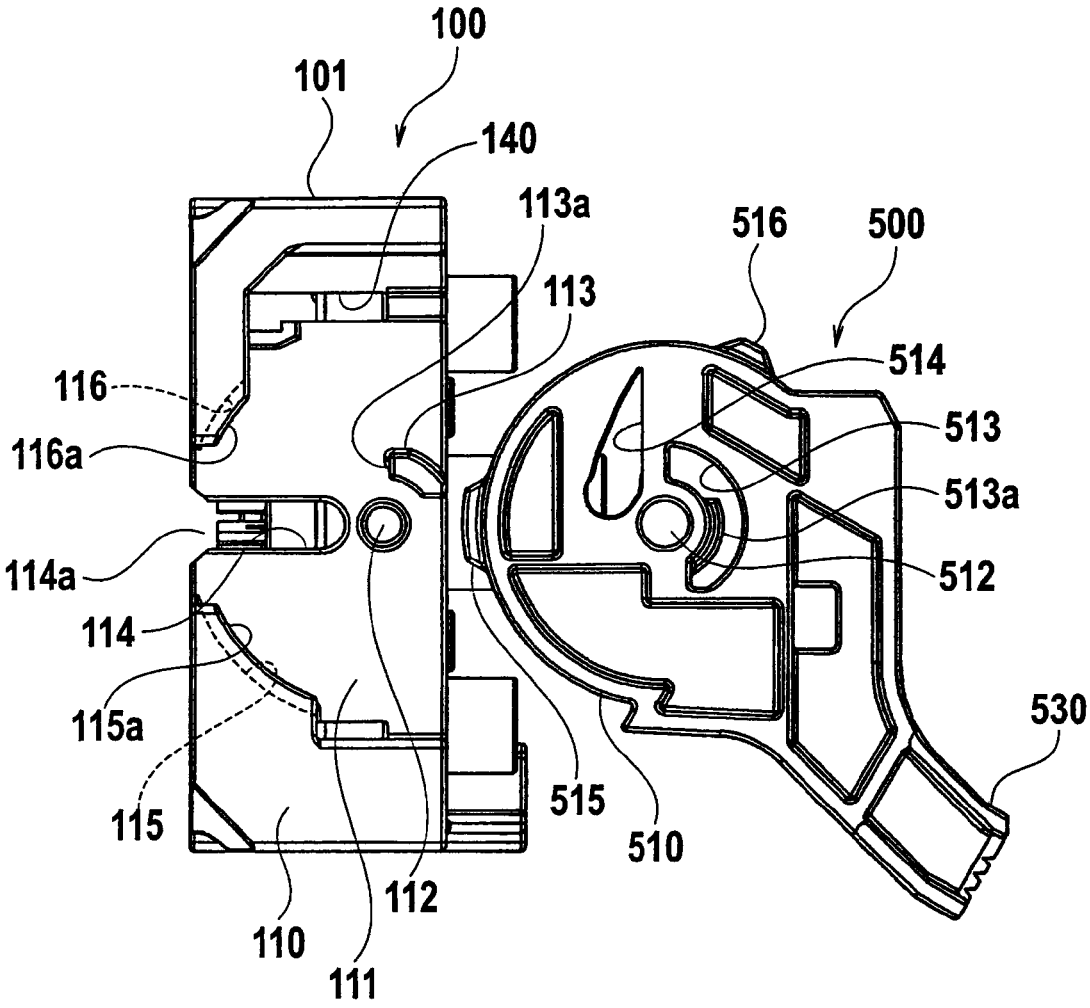
FIG. 11 is a side view showing a state before attaching a lever to the female connector.

Furthermore, curved walls 115, 116, which guide the circumferential edge of the respective side plate 510 are provided on a circumferential edge of the respective lever attaching face 111 of the female connector housing 101. The curved walls 115, 116 are provided on both sides of the guiding slit 114 respectively (FIG. 11). Flanges 115*a*, 116*a* extends from edges of the curved walls 115, 116 respectively in parallel to the respective lever attaching face 111. The uncoupling of the lever 500 from the female connector housing 101 is prevented by engagement between the flanges 115*a*, 116*a* and the tabs 515, 516. In other words, arched grooves are formed in ranges of the flanges 115*a*, 116*a* in order to hold the tabs 515, 516 slidably.

Figure 10:
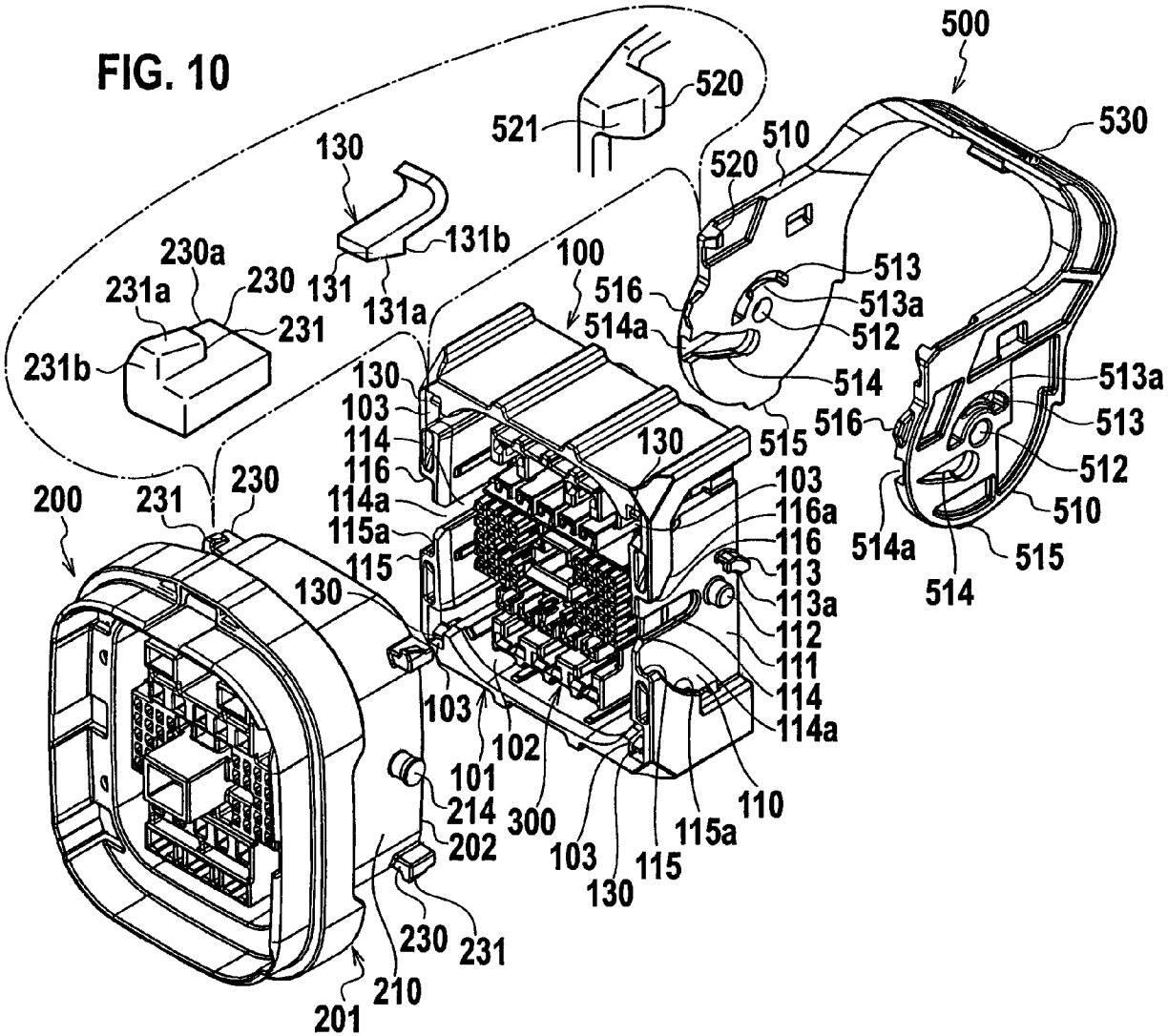
FIG. 10 is an exploded perspective view showing main elements of the embodiment (some portions are shown in close-up view)

As shown in FIG. 10, a pair of cam pins 214, which is guided by the cam grooves 514 of the lever 500, is provided on a side face of the hood 202 of the male connector housing 201. The pair of cam pins 214 is guided by the cam grooves 514 while sliding through the guiding slit 114 of the female connector housing 101.

In the present embodiment of the lever type connector, the attaching position of the lever 500 onto the female connector housing 101 is determined in a special position in relation to the ordinary rotating range of the lever 500. This point will be described hereinafter with an assembling procedure.

Figure 12:
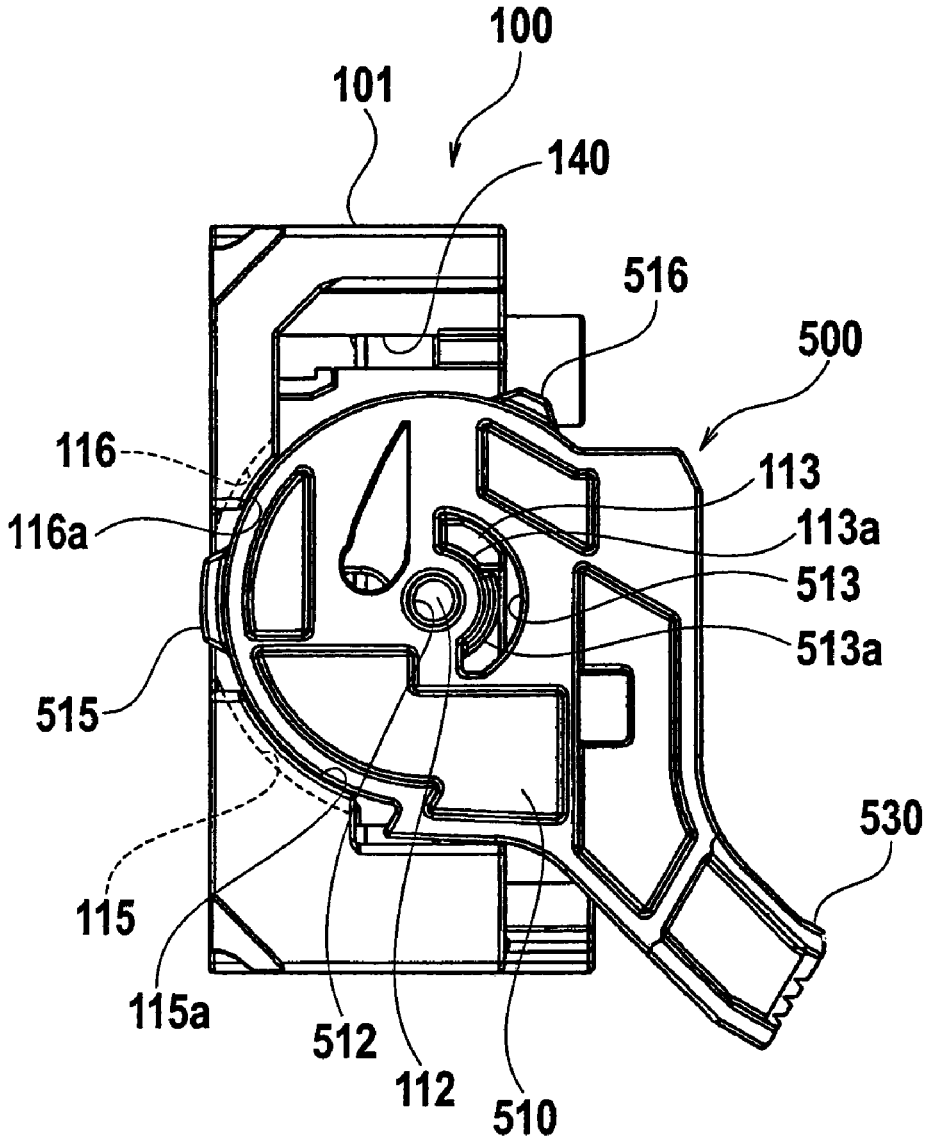
FIG. 12 is a side view showing a state after attaching the lever to the female connector.

FIG. 11 and FIG. 12 show a positional relationship between the female connector housing 101 and the lever 500 at attaching the lever 500 onto the female connector housing 101. The positions of the tabs 515, 516 of the lever 500 is unmatched with the positions of the flanges 115*a*, 116*a* of the female connector housing 101 respectively when the lever 500 is set at the attaching position. In addition, the position of the hook 113 and the position of the slit 513 are coincident, but the hook 113 and the tab 513*a* of the slit 513 are unmatched. In other words, holding mechanism (the tabs 113*a*, 513*a*, 515, 516 and the flanges 115*a*, 116*a*) is in an unholding state when the lever 500 is set at the attaching position.

In this state, the axial holes 512 of the lever 500 are coupled with the pins 112 of the female connector housing 101 respectively. When the lever 500 is attached onto the female connector housing 101, the lever 500 is bent in order to widen the distance between the pair of the side plates 510. As the axial holes 512 are coupled with the pins 112 respectively, both of the side plates 510 of the lever 500 are attached onto the lever attaching faces 111 respectively. Here, the hooks 113 are inserted into the slits 513 respectively, but the tabs 113*a* of the hook 113 and the tabs 513*a* of the slit 513 are unmatched. FIG. 12 shows a state immediately after the attaching of the lever 500.

Figure 13:
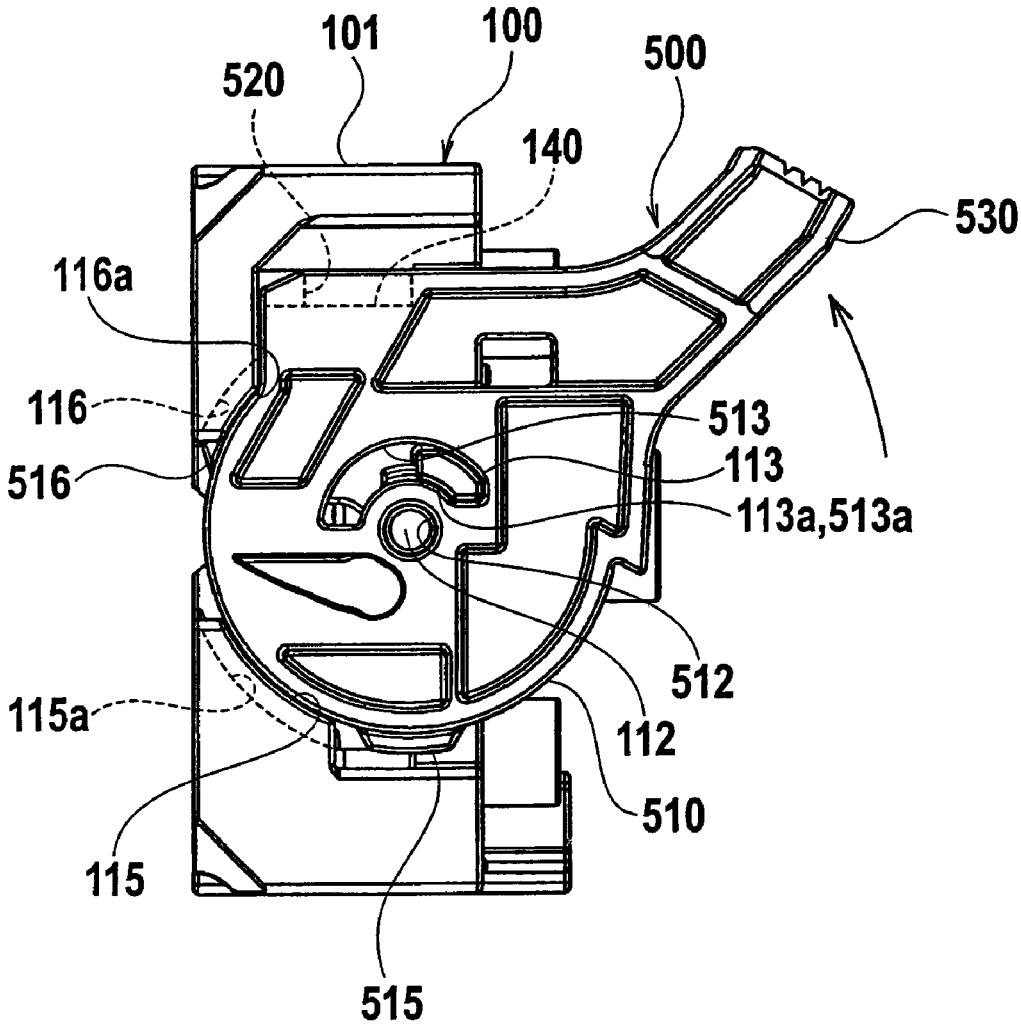
FIG. 13 is a side view showing a state in which the lever is rotated to a start position.

And then, the lever 500 is rotated in a direction of an arrow in FIG. 13 until the hooks 113 hits opposite ends of the slits 513 respectively. The tabs 113*a* of the hooks 113 and the tabs 513*a* of the slit 513 are overlapped respectively, and the lever 500 is held by the hooks 513. In addition, the tabs 515, 516 on the circumferential edges of the side plates 510 of the lever 500 are held by the flanges 115*a*, 116*a* respectively.

A position at which the hooks 113 hit the end of the slits 513 is a start position of the rotation of the lever 500. The entry gates 514*a* of the cam grooves 514 and the entry gates 114*a* of the guiding slits 114 are matched when the lever 500 is positioned at the start position, and it becomes possible to insert the cam pins 214 of the male connector housing 201 into them.

Guiding structure is provided on the connector housings 101, 201 for guiding the respective cam pin 214 to the entry gate 514*a* of the respective cam groove 514 at the initial stage of connecting the connectors 100, 200. The guiding structure includes temporary connecting structure for holding a temporarily connecting state of the connectors 100, 200 at the connecting initial stage.

As shown in FIG. 10, the temporary connecting structure is provided on the connector housings 101, 201 for holding the temporarily connecting state. The temporary connecting structure on the female connector housing 101 is configured with barbed tabs 130. The temporary connecting structure on the male connector housing 201 is configured with projecting tabs 230 projected from an outer circumferential surface of the hood 202.

The barbed tabs 130 are disposed with in insertion holes 103 provided on four corners of an outer circumferential wall of the female connector housing 101, respectively. The respective barbed tab 130 is engaged with the respective projecting tab 230 when the respective projecting tab 230 is inserted into the respective insertion hole 103.

Each of the barbed tab 130 has a pawl 131 and each projecting tab 230 has a projection 231. An engaging plane 131*b* of the pawl 131 and an engaging plane 231*b* are engaged each other to produce engaging force of the temporary connecting. Engaging planes 131*b*, 231*b* are almost perpendicular to the connecting direction of the connectors 100, 200.

Each of the pawls 131 has a guiding slope 131*a* and each of the projection 231 has a guiding slope 231*a*, as elements of the guiding structure. The guiding slopes 131*a*, 231*a* are frictioned each other as the initial connection of the connector housings 101, 201 proceeds, and align positions of the connector housings 101, 201. Therefore, the barbed tabs 130 and the projecting tabs 230 (the guiding slopes 131*a*, 231*a*) function as frictioning portions for guiding the cam pins 214 to the cam grooves 514 respectively. The guiding slopes 131*a*, 231*a* are disposed on forward positions to the engaging planes 131*b*, 231*b* in the connecting direction, respectively.

Furthermore, temporary holding structure, which holds the lever 500 temporarily at the start position of rotation, is provided between the lever 500 and the female connector housing 101. The temporary holding structure on the lever 500 is configured with holding projections 520, each of which is projected from an inner surfaces of the respective side plate 510 of the lever 500. The temporary holding structure on the female connector housing 101 is configured with holding holes 140, each of which is engaged with the respective holding projection 520 (FIG. 11). Each of the holding holes 140 communicates with the respective insertion hole 103, within which the barbed tab 130 is disposed. A part of the holding projection 520 is exposed within the insertion hole 103 when the holding projection 520 engages with the holding hole 140, respectively.

Since the temporary holding structure has above described structure, an engagement between the holding projections 520 and the holding holes 140 is released when the temporary connecting structure (the barbed tabs 130 and the projecting tabs 230) is connected temporarily. In detail, temporary holding of the lever 500 is released when the projecting tabs 230 push the holding projections 520 toward the outside through the holding holes 140, respectively.

Each of the holding projections 520 has a guiding slope 521 on its inner front portion and each of the projecting tabs 230 has a guiding slope 230*a* on its outer side portion. The guiding slope 230*a* of the projecting tab 230 contacts with the guiding slope 521 of the holding projection 520 respectively at the temporary connection of the connector 100, 200. At this time, elastic restoring forces of the side plates 510, which have the holding projections 520, act on the male connector housing 201 via the projecting tabs 230. The elastic restoring forces are almost equal and act from both side of the male connector housing 201. The two elastic restoring forces act in opposite directions each other. Therefore, the elastic restoring forces can adjust a lateral relative position between the female connector housings 101 and the male connector housing 201.

Figure 14:
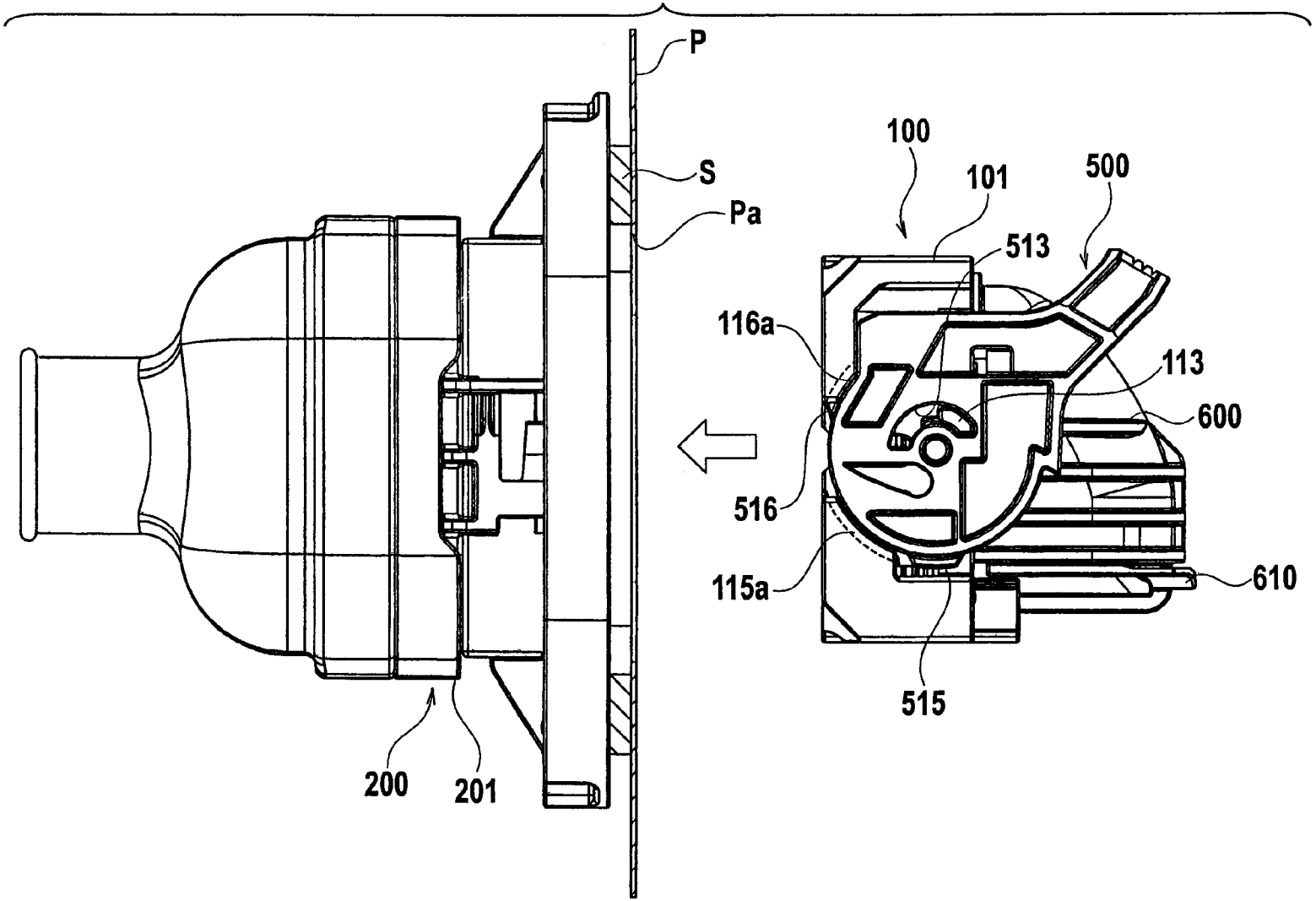
FIG. 14 is a side view showing a state in which the female and male connectors are set face to face with a car body panel therebetween.

Next, connecting process will be described. When the pair of connectors 100 and 200 are to be connected, as shown in FIG. 14, the female connector 100 with the lever 500 set at the start position (shown in FIG. 13) is positioned against the male connector 200 attached on a car body panel P. In FIG. 14, Pa is an aperture of the car body panel P and S is a sealing member.

Figure 15:
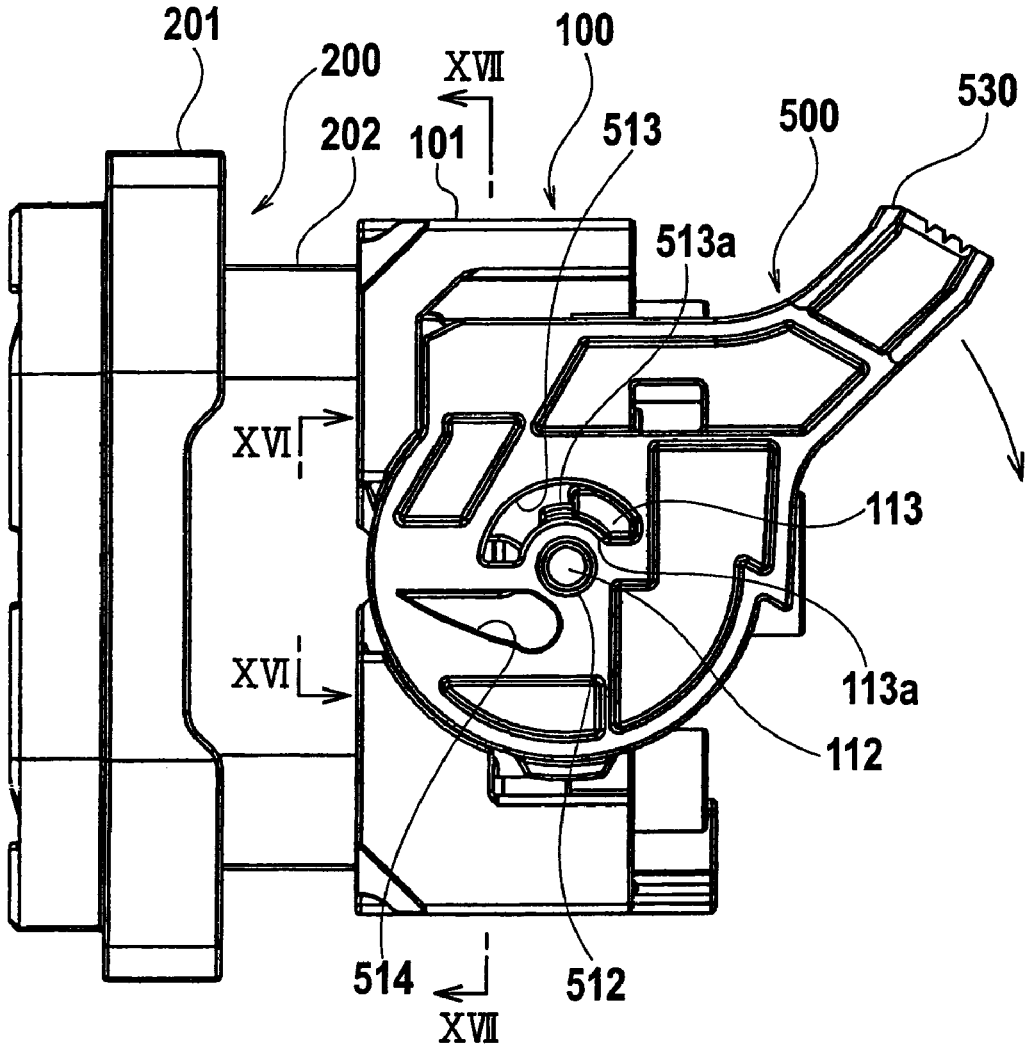
FIG. 15 is a side view showing an initial stage of connecting the female and male connectors.
Figure 16:
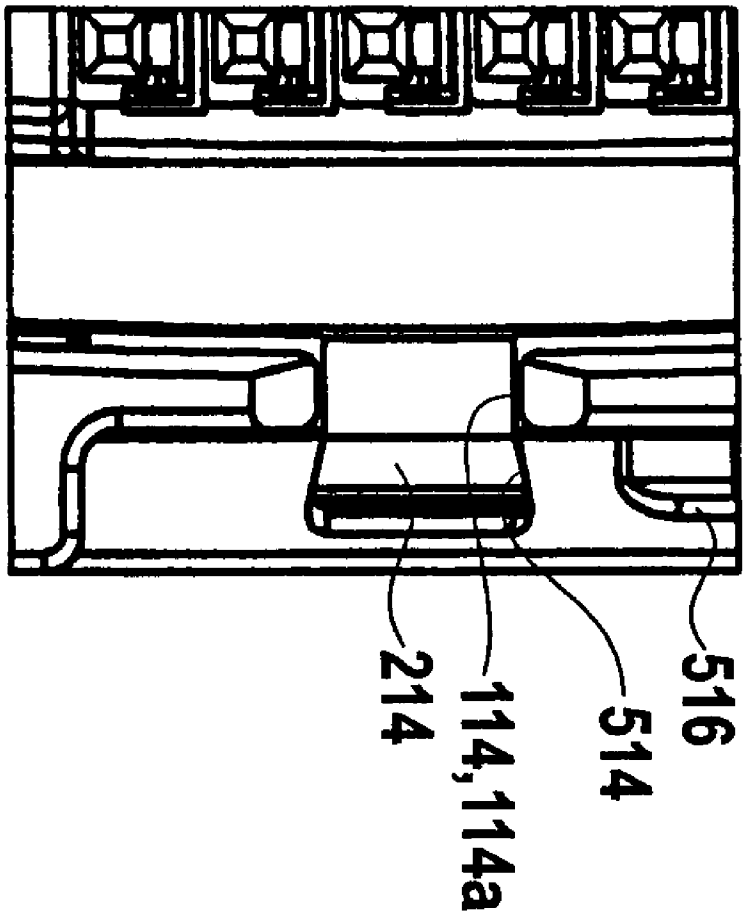
FIG. 16 is a view from a direction of arrows XVI-XVI in FIG. 15.
Figure 17:
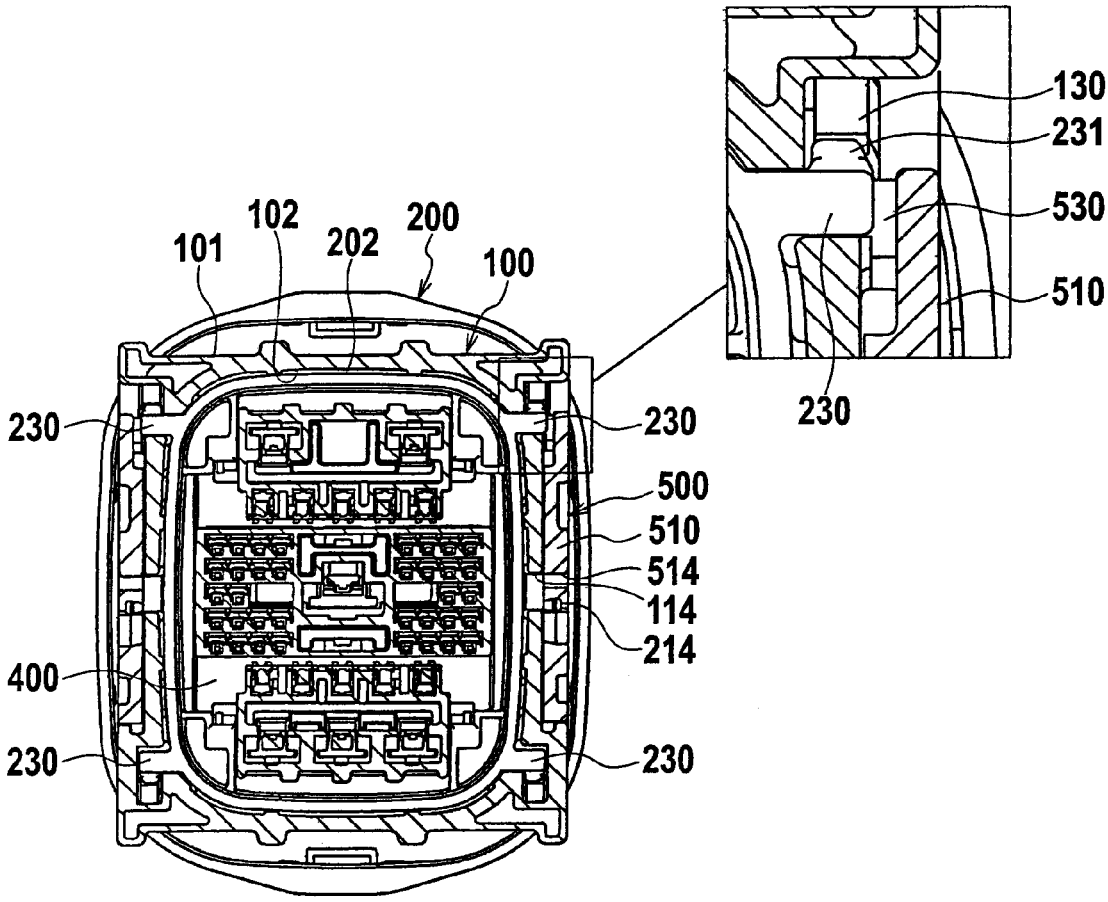
FIG. 17 is a cross-sectional view taken along line XVII-XVII in FIG. 15 (a portion is shown in close-up view)

In this state, the female connector 100 and the male connector 200 are connected temporarily (initial connecting). The cam pins 214 of the male connector housing 201 are entered from the entry gates 114*a*, 514*a* into the guiding slits 114 of the female connector housing 101 and the cam grooves 514 of the lever 500, respectively. FIG. 15 and FIG. 17 show a state at this point, and FIG. 16 shows a state in which the cam pins 214 have entered into the guiding slits 114 and the cam grooves 514.

A perpendicular relative position between the female connector housing 101 and the male connector housing 201 can be aligned properly by guiding effect with the friction between the guiding slopes 131*a* of the barbed tabs 130 and the guiding slopes 231*a* of the projecting tabs 230, as the temporary connecting proceeds.

In addition, temporary holding of the lever 500 is released because the projecting tabs 230 pushes the holding projections 520 toward the outside respectively, as the temporary connecting proceeds. Furthermore, at the same time, a lateral position between the female connector housing 101 and the male connector housing 201 can be aligned properly by elastic restoring forces of the side plates 510.

Since the perpendicular and lateral relative positions between the female connector housing 101 and the male connector housing 201 can be aligned properly, the cam pins 214 and the entry gates 514*a* of the cam grooves 514 become coincide to enter the cam pins 214 smoothly into the entry gates 514*a*, respectively.

Furthermore, a relative position in the connecting direction between the female connector housing 101 and the male connector housing 201 can be aligned by the temporary connecting of the temporary connecting structure (the barbed tabs 130 and the projecting tabs 230). And the position can be temporarily held. Therefore, the cam pins 214 can be entered within the cam grooves 514 smoothly by rotating the lever 500 which has been released under the temporary connecting.

In this case, since the temporary holding of the lever 500 can be released when the temporary connecting structure (the barbed tabs 130 and the projecting tabs 230) becomes a temporarily connecting state, the lever 500 can be rotated as a next operation just after the temporarily connecting state. In other words, the lever 500 can be held until the connectors 100, 200 are temporarily connected, and can be rotated only after the connectors 100, 200 are temporarily connected. As a result, operating status (held or rotatable) of the lever 500 can be changed without the need of a special operation, and then connecting workability can be improved effectively.

Furthermore, since the guiding slopes 131*a*, 231*a*, 230*a*, 521 are provided as described above, the cam pins 214 can be guided properly to the entry gates 114*a*, 514*a*, at the temporary (initial) connection of the connectors 100, 200 even when connecting potions of the both connectors have much looseness.

Figure 18:
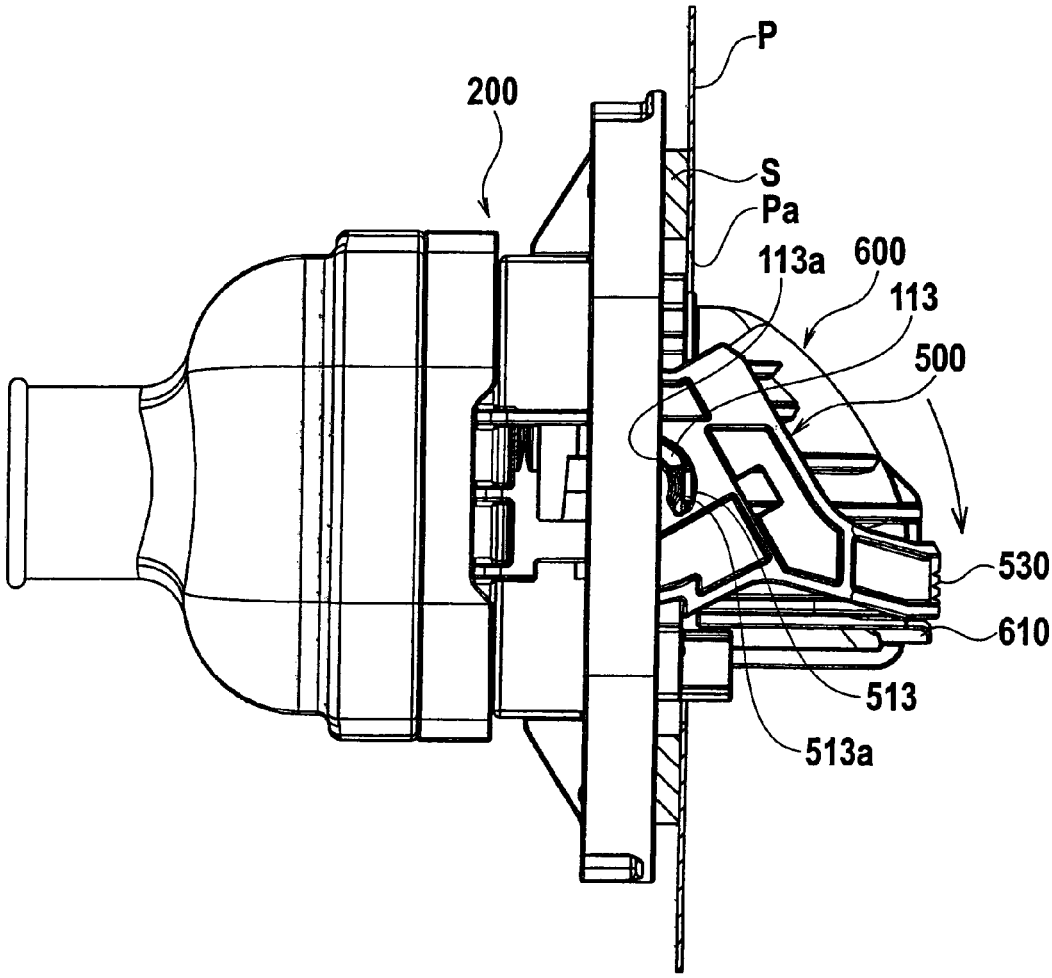
FIG. 18 is a side view showing a state in which the female and male connectors are connected by rotating the lever to an end position.
Figure 19:
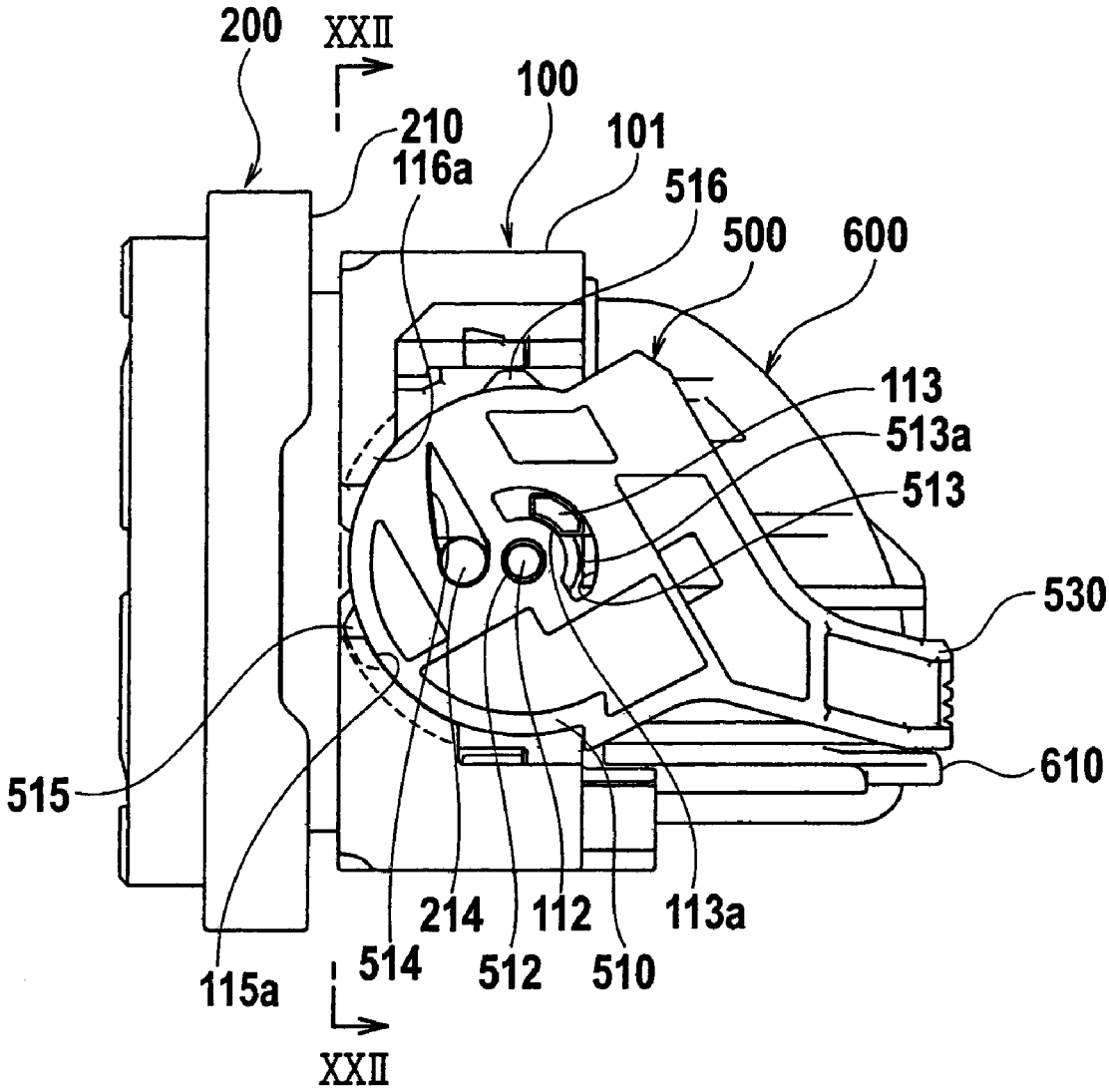
FIG. 19 is a side view showing only the female and male connectors of FIG. 18.
Figure 20:
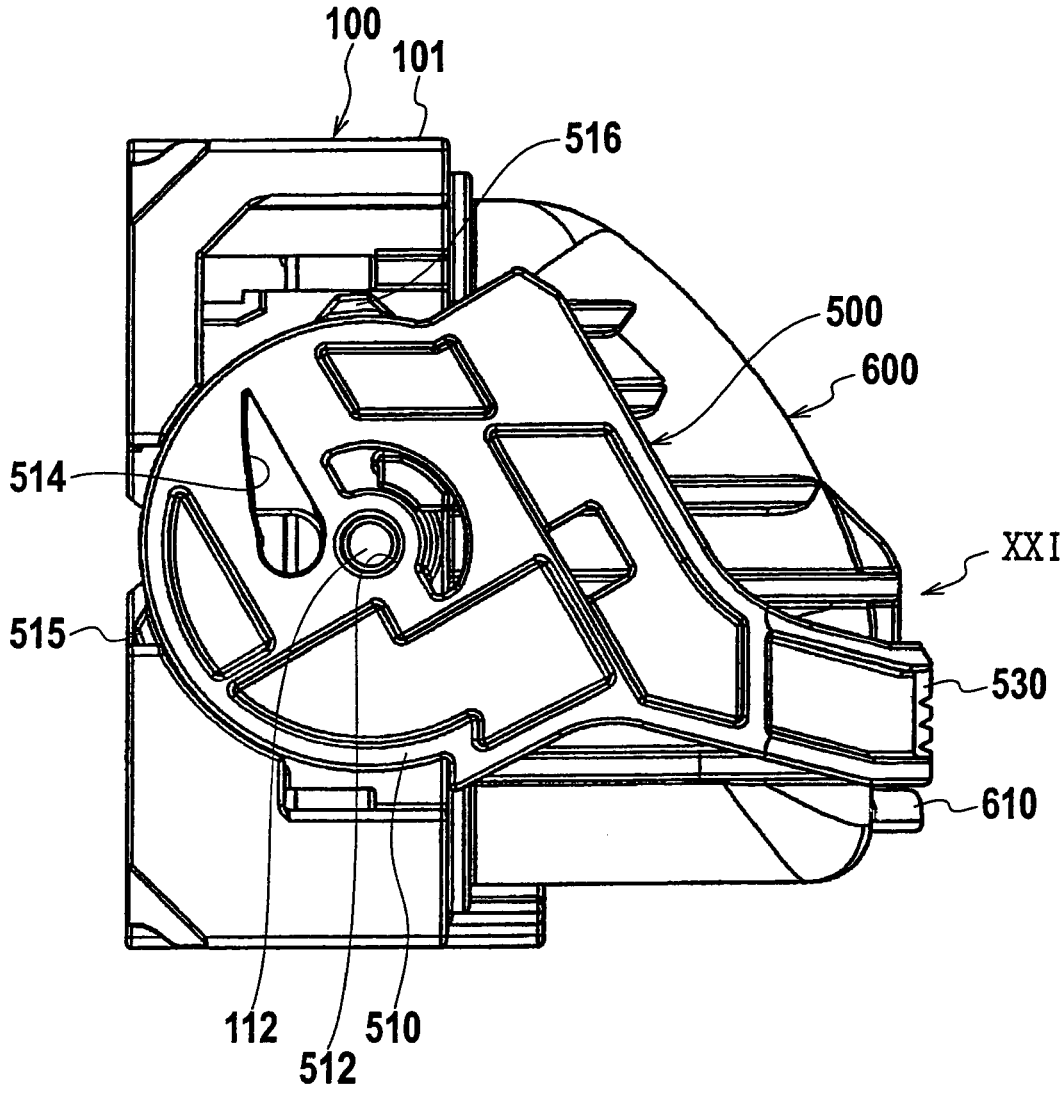
FIG. 20 is a side view showing a relationship among the female and male connectors and the lever shown in FIG. 19
Figure 21:
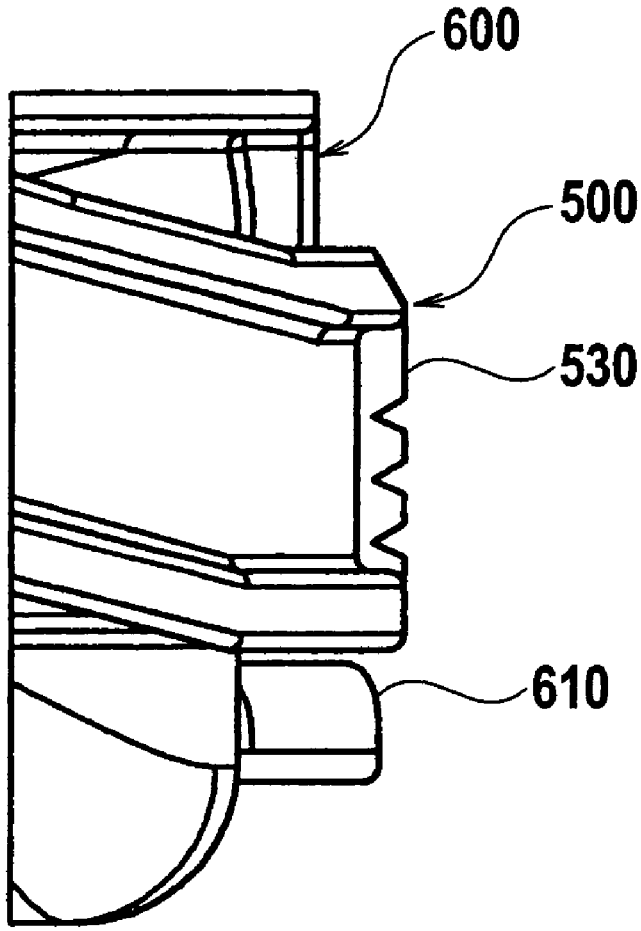
FIG. 21 is an enlarged view of a portion XXI shown in FIG. 20.
Figure 22:
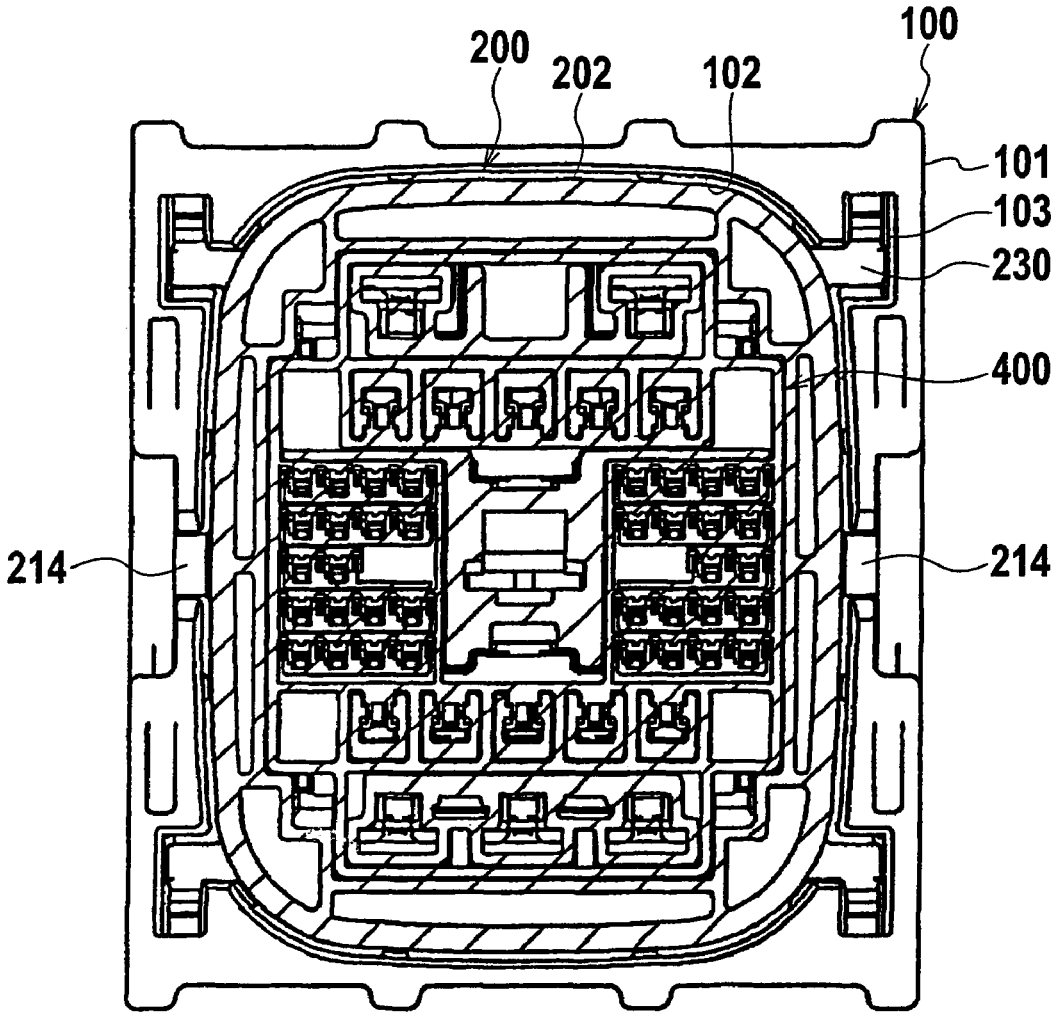
FIG. 22 is a cross-sectional view taken along line XXII-XXII in FIG. 19.
Figure 23:
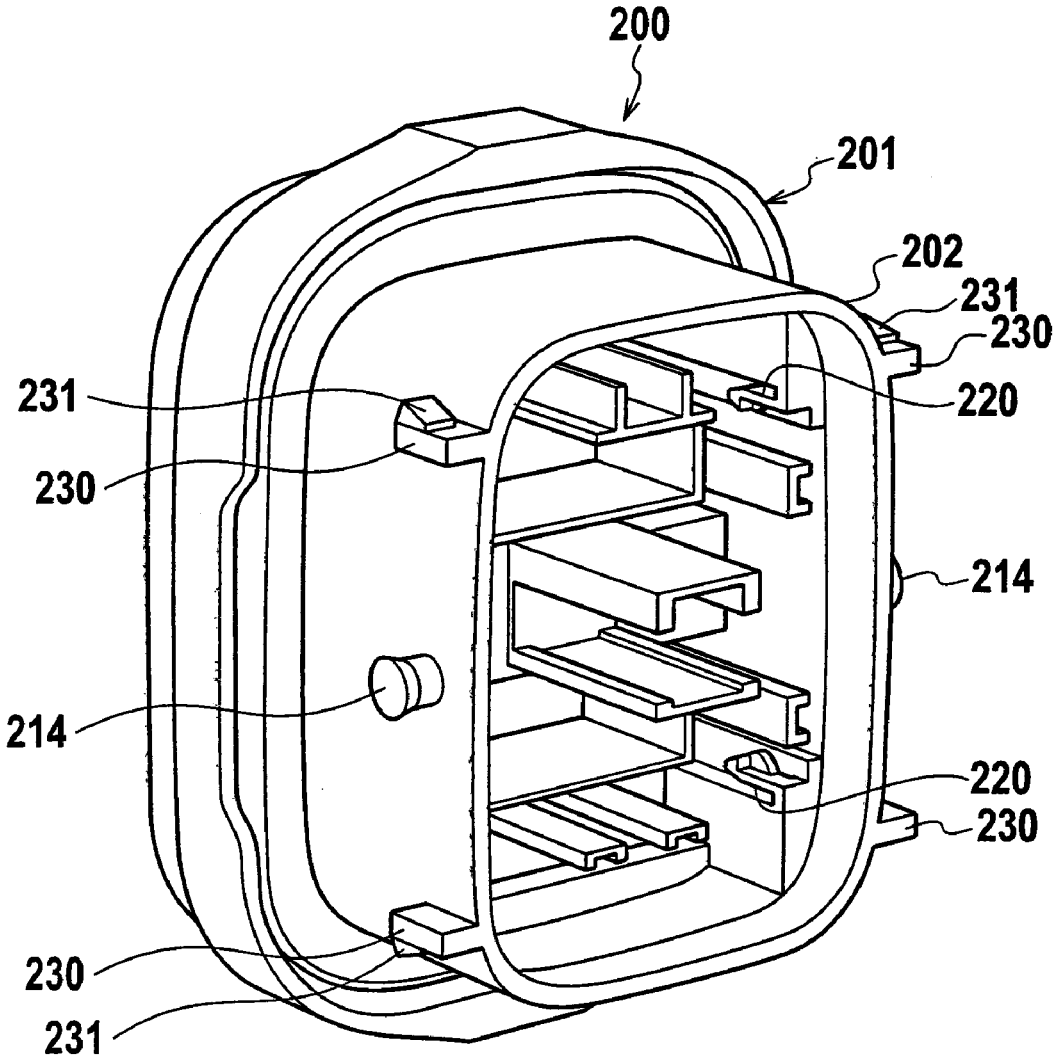
FIG. 23 is a perspective view showing the male connector housing viewed from its front side.
Figure 24:
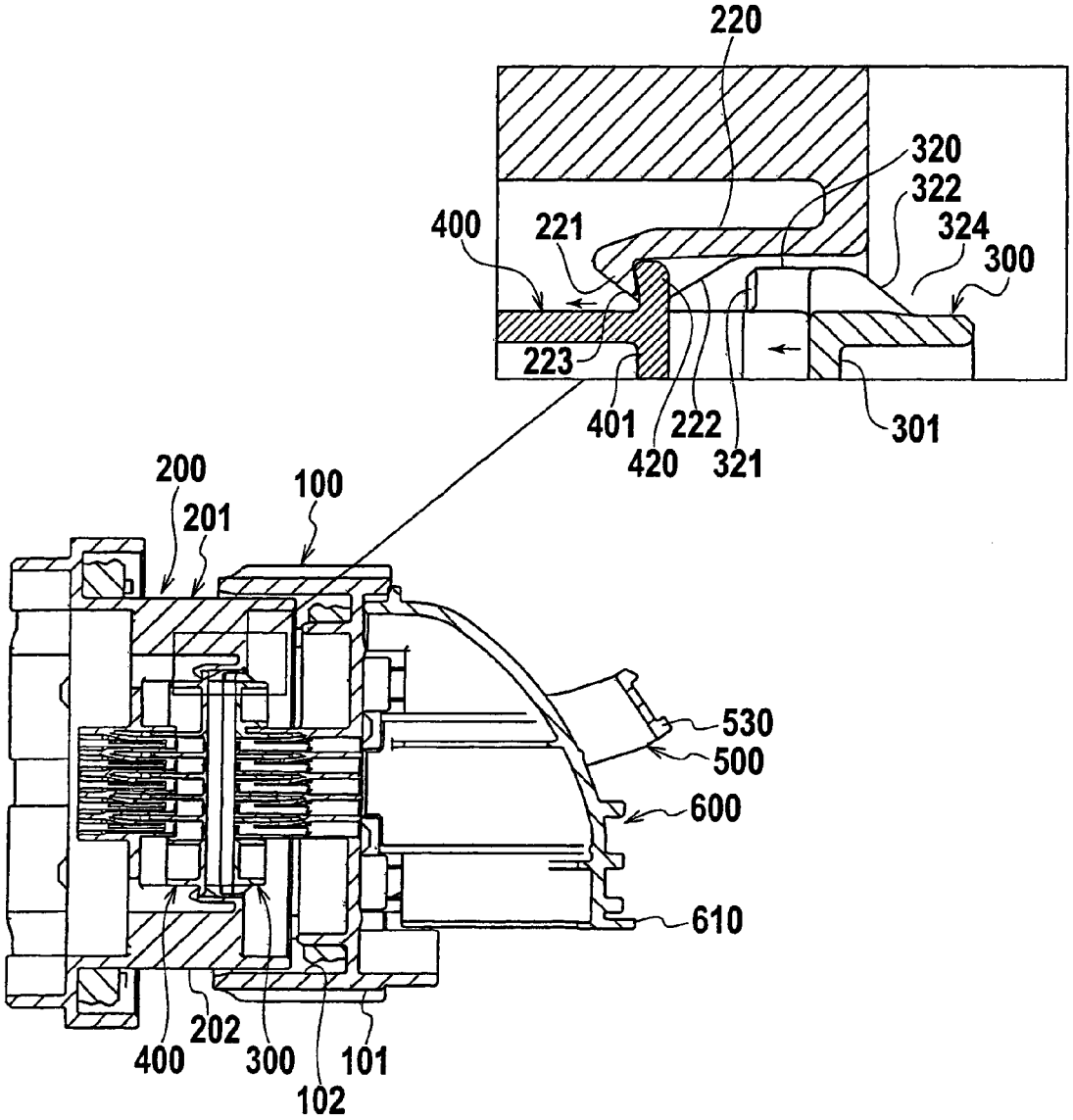
FIG. 24 is a cross-sectional view showing an initial stage of connecting the female and male connectors (a portion is shown in close-up view)

From the state of FIG. 15, the lever 500 is rotated in a direction of an arrow in FIG. 15 using the knob 530, and moved to the position shown in FIG. 18 to FIG. 20. And then, the connector housings 101, 201 are completely connected by the cam structure between the cam grooves 514 and the cam pins 214. A position of the lever 500 at this point is an end position of the rotation. Note that, in FIG. 18 to FIG. 20, the cover 600 is attached on a backside of the female connector 100. The cover 600 is attached after the installation of metallic terminals and electric wires into the female connector 100 is finished. The electric wires are collectively lead out to one direction by the cover 600 (downwards in FIG. 18 to FIG. 20).

When the rotation range from the start position to the end position is defined as the ordinary rotation rage for connecting the connector, the attaching position of the lever 500 described above is set outside of the ordinary rotation range.

Consequently, the lever 500 will not be rotated to the attaching position by error during an ordinary operation. The lever 500 can be detached at the attaching position. However, the lever 500 will not be rotated to the attaching position during the ordinary operation, so that the lever 500 will not uncouple even if an external force (a lateral load onto the lever 500 or the like) is applied during the ordinary operation of the lever 500 (the connector connecting operation). Note that, it is also possible to prevent the uncoupling of the lever 500 by setting a coupling structure between the lever 500 and the female connector housing 101 severely and coupling the lever 500 with the female connector housing 101 forcefully. However, the attaching operation of the lever 500 onto the female connector housing 101 becomes cumbersome. In the present embodiment, the attaching position of the lever 500 is set specially so that the attaching operation of the lever 500 does not become cumbersome and the attaching operation can be effectively improved.

Furthermore, in the present embodiment, the attaching position of the lever 500 is set in a vicinity of the end position of the lever 500 outside of the ordinary operation range. Therefore, a waiting state for accepting the cam pins 214 (that is, connecting the connector) can be made ready only by rotating the lever 500 from the attaching position to the start position thorough the end position, as described above. In other words, the attaching position (that is, a uncoupling position) of the lever 500 is set at a position far from the start position, so that the lever 500 set at the start position will not be returned back to the attaching position by error.

Note that, the lever 500 has already completed a required function (connecting function) when the lever 500 is positioned at the end position as shown in FIG. 18 to FIG. 20. For this reason, there is no practical adverse affect even if the lever 500 is rotated back to the attaching position by error from the end position.

As shown in FIG. 19 and FIG. 20, the hooks 113 have not hit the ends of the slits 513 (ends near the attaching position) yet when the lever 500 is positioned at the end position. Therefore, if the rotation of the lever 500 were not regulated, it would be possible to rotate the lever 500 further. However, in the present embodiment, as shown in FIG. 18 to FIG. 21, a stopper 610, which contacts with the knob 530 when the lever 500 is positioned at the end position, is provided on the cover 600 in order to prevent the further rotation of the lever 500 beyond the end position. As a result, the lever 500 will not be rotated back to the attaching position by error, and the uncoupling of the lever 500 under a connected state of the connector cannot occur.

Furthermore, within the ordinary rotating range of the lever 500 from the start position to the end position, the tabs 113*a* of the hooks 113 hold the tabs 513*a* of the slits 513. In addition, the flanges 115*a*, 116*a* hold the tabs 515, 516 alternatively or simultaneously according to the rotation position of the lever 500. Therefore, the uncoupling of the lever 500 can be prevented more surely during the ordinary operation of connecting the connector.

Furthermore, the stopper 610 is provided on the cover 600. Since the cover 600 is attached to the female connector housing 101 after attaching the lever 500 on to the female connector housing 101, the attaching process of the lever 500 onto the female connector housing 101 can be done easily before attaching the cover 600.

On the contrary, the lever 500 is rotated in an opposite direction when the connectors 100 and 200 are to be disconnected. Then, the connector housings 101 and 201 are disconnected by utilizing the principle of leverage between the cam grooves 514 and the cam pins 214. In this case, since uncoupling of the lever 500 never occurs by the stopper 600, the lever 500 is surely held at the end position by the stopper 610. Therefore, the connectors 100 and 200 can be uncoupled by using the lever 500 which has not uncoupled.

According to the present embodiment, processes and effects described hereinafter can be achieved.

Since the release projections 320 of the front holder 300 firstly contact the first slopes 222 of the barbed arms 220 respectively when the connectors 100, 200 are to be connected (shown in FIG. 24), the barbed arms 220 are bent toward the release directions (upward in FIG. 24) and then temporary engagements of the hooking tabs 420 of the movable plate 400 are released.

After the release of the engagements between the barbed arms 220 and the hooking tabs 420, the movable plate 400 can become slidable. As the connecting operation proceeds, the front holder 300 will contact the movable plate 400 and then push it backward.

The movable plate 400 is pushed to an end position under the complete connection of the connectors 100, 200, as shown in FIG. 25. In this state, since the spaces 324 are secured behind the release projections 320 of the front holder 300 respectively, the barbed arms 220, which have restored their bending at the complete connection after the temporary connection, are stowed in the spaces 324 respectively.

Therefore, continuous bending of the barbed arms 220 under the connecting state of the connectors 100, 200 is prevented. As a result, reduction of temporary connecting performance is prevented. In addition, since the barbed arms 220 are not bent under the temporary or complete connecting state, it is prevented that the external force would act on the barbed arms 220 even when the external force acts on the connectors 100, 200. As a result, durability against an external force is improved.

Furthermore, the release projections 320, which bend the barbed arms 220 toward the release directions respectively as the connection of the connectors 100, 200 proceeds, are provided not directly on the female connector housing 101 but on the front holder 300 attached onto the female connector housing 101. Since the respective space 324 would not become an undercut portion of injection molding, an access hole, which is often made by a telescoping shutoff of injection molding to mold an undercut portion, is not made on the female connector 100 for the spaces 324. Therefore, it could never happen that water infiltrates into the inside of the connectors 100, 200 through an access hole. As a result, deterioration of waterproofing and noise-and-vibration performances concerning the female connector 100 is prevented.

Furthermore, in the present embodiment, each pair of the pawl 221 and the hooking tab 420 offsets from each pair of the release projection 320 and the first slope 222 respectively in a perpendicular plane to a connecting direction of the connectors 100, 200. Therefore, compact design, such as short length in the connecting direction, can be provided.

Furthermore, the second slope 223, which is disposed on a distal end of the respective barbed arm 223, bends the barbed arms 220 toward the release direction by contacting with the release projection 320 of the front holder 300 at the disconnection of the connectors 100, 200. Therefore, The connectors 100, 200 can be disconnected smoothly.

What is claimed is:

1. A lever connector, comprising:

a first connector housing which has female terminals therein and an aperture opening forward;

a second connector housing to be connected with the first connector housing, which has male terminals to be electrically connected with the female terminals and has an aperture opening forward;

a front holder which is inserted through the aperture of the first connector housing and fixed thereon; and a movable guide member which is inserted through the aperture of the second connector housing and slidably attached thereto, wherein the movable guide member is temporarily held at a temporary holding position before connection of the female and male connector housings, and released from a temporary holding and slid toward an end position by the front holder to guide the male terminals into the female terminals as the connection proceeds, an elastic arm, which temporarily holds the movable guide member at the temporary holding position, is provided inside the second connector housing, and a release projection, which is contacted with the elastic arm to bend the elastic arm toward a release direction for releasing the temporary holding, is provided on the front holder, a space, which stows the elastic arm restoring bending after releasing the temporary holding, is secured behind the release projection in a connecting direction.

2. The lever connector according to claim 1, further comprising:

an engaging portion, which is to be engaged with the elastic arm, is provided on the movable guide member;

a pawl, which is engaged with the engaging portion to hold the movable guide member temporarily, is disposed on a distal end of the elastic arm;

a first slope, which is to be contacted with the release projection as the connection proceeds to receive a force for bending the elastic arm toward a release direction, is provided on the elastic arm; and a pair of the pawl and the engaging portion offsets from a pair of the release projection and the first slope in a perpendicular plane to the connecting direction.

3. The lever connector according to claim 2, further comprising:

a second slope, which is to be contacted with the release projection as a disconnection proceeds to receive a force for bending the elastic arm toward a release direction, is provided on the distal end of the elastic arm.

4. The lever connector according to claim 3, further comprising:

a lever which is rotatably attached to one of the first and second connector housings and has cam grooves; and cam pins which are provided on another of the first and second connector housings and guided by the cam grooves respectively, wherein the connection or disconnection of the first and second connector housings is assisted by rotating the lever in a state where the cam pins are inserted into the cam grooves respectively.

* * * * *